US012312922B2

(12) United States Patent
Loehken et al.

(10) Patent No.: US 12,312,922 B2
(45) Date of Patent: May 27, 2025

(54) PERFORATING GUN ASSEMBLY AND COMPONENTS

(71) Applicant: DynaEnergetics Europe GmbH, Troisdorf (DE)

(72) Inventors: Joern Olaf Loehken, Troisdorf (DE); Stefan Purcelean, Troisdorf (DE); Joerg Mueller, Bonn-Lengsdorf (DE); Benjamin Donauer, Lohmar (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/260,686

(22) PCT Filed: May 24, 2021

(86) PCT No.: PCT/EP2021/063761

§ 371 (c)(1),
(2) Date: Jul. 7, 2023

(87) PCT Pub. No.: WO2022/148557

PCT Pub. Date: Jul. 14, 2022

(65) Prior Publication Data

US 2024/0076965 A1 Mar. 7, 2024

Related U.S. Application Data

(60) Provisional application No. 63/157,037, filed on Mar. 5, 2021, provisional application No. 63/135,944, filed
(Continued)

(51) Int. Cl.
*E21B 43/117* (2006.01)

(52) U.S. Cl.
CPC ..... *E21B 43/117* (2013.01)

(58) Field of Classification Search
CPC .... E21B 43/116; E21B 43/117; E21B 43/119; E21B 43/1185
See application file for complete search history.

(56) References Cited

U.S. PATENT DOCUMENTS 214,754 A 4/1879 Brock et al.
1,757,288 A 5/1930 Bleecker
(Continued)

FOREIGN PATENT DOCUMENTS

EP 2282003 A2 2/2011
WO 2001004452 A1 1/2001
(Continued)

OTHER PUBLICATIONS

U.S. Appl. No. 16/287,150, filed Feb. 27, 2019, Frank Haron Preiss.
(Continued)

*Primary Examiner* — Caroline N Butcher
(74) *Attorney, Agent, or Firm* — Womble Bond Dickinson (US) LLP

(57) ABSTRACT

A jacket may include a back wall, a top wall, a bottom wall, a first sidewall, a second sidewall, an open front portion opposite the back wall portion, an internal cavity configured to receive the shaped charge via the open front portion, a key configured to be received within one of a plurality of orientation slots formed in a shaped charge carrier; and a retention latch extending from an internal surface of at least one of the top wall, the bottom wall, the first sidewall or the second sidewall. The retention latch may extend toward the internal cavity and is configured to secure the shaped charge within the internal cavity.

16 Claims, 23 Drawing Sheets

Related U.S. Application Data on Jan. 11, 2021, provisional application No. 63/135,009, filed on Jan. 8, 2021.

(56) References Cited

U.S. PATENT DOCUMENTS

| | | | |
|---|---|---|---|
| 2,062,974 | A | 12/1936 | Lane |
| 2,142,572 | A | 1/1939 | Metzner |
| 2,147,544 | A | 2/1939 | Potts |
| 2,228,873 | A | 1/1941 | Hardt et al. |
| 2,252,270 | A | 8/1941 | Miller |
| 2,296,346 | A | 9/1942 | Hearn |
| 2,308,004 | A | 1/1943 | Hart |
| 2,418,486 | A | 4/1947 | Smylie |
| 2,439,394 | A | 4/1948 | Lanzalotti et al. |
| 2,462,784 | A | 2/1949 | Smith |
| 2,550,004 | A | 4/1951 | Doll |
| 2,598,651 | A | 5/1952 | Spencer |
| 2,618,343 | A | 11/1952 | Conrad |
| 2,667,836 | A | 2/1954 | Church et al. |
| 2,681,114 | A | 6/1954 | Conrad |
| 2,687,092 | A | 8/1954 | Duesing |
| 2,695,064 | A | 11/1954 | Ragan et al. |
| 2,696,259 | A | 12/1954 | Greene |
| 2,713,909 | A | 7/1955 | Baker |
| 2,713,910 | A | 7/1955 | Baker et al. |
| 2,734,456 | A | 2/1956 | Sweetman |
| 2,755,863 | A | 7/1956 | Stansbury et al. |
| 2,756,958 | A | 7/1956 | Binns et al. |
| 2,765,739 | A | 10/1956 | Mohaupt et al. |
| 2,769,701 | A | 11/1956 | Frederick |
| 2,785,631 | A | 3/1957 | Blanchard |
| 2,815,816 | A | 12/1957 | Baker |
| 2,946,283 | A | 7/1960 | Udry |
| 2,979,904 | A | 4/1961 | Royer |
| 2,982,210 | A | 5/1961 | Andrew et al. |
| 3,013,491 | A | 12/1961 | Poulter |
| 3,024,843 | A | 3/1962 | Dean |
| 3,026,939 | A | 3/1962 | Sweetman |
| 3,031,964 | A | 5/1962 | Chesnut |
| 3,036,636 | A | 5/1962 | Clark |
| 3,055,430 | A | 9/1962 | Campbell |
| 3,076,507 | A | 2/1963 | Sweetman |
| 3,077,834 | A | 2/1963 | Caldwell |
| 3,094,166 | A | 6/1963 | Mccullough |
| 3,116,690 | A | 1/1964 | Gillingham et al. |
| 3,119,178 | A | 1/1964 | Owen et al. |
| 3,125,024 | A | 3/1964 | Hicks et al. |
| 3,140,537 | A | 7/1964 | Popoff |
| 3,154,632 | A | 10/1964 | Browne |
| 3,160,209 | A | 12/1964 | Bonner |
| 3,211,222 | A | 10/1965 | Myers |
| 3,220,480 | A | 11/1965 | Myers |
| 3,233,674 | A | 2/1966 | Kurt |
| 3,244,232 | A | 4/1966 | Myers |
| 3,264,994 | A | 8/1966 | Kurt |
| 3,266,575 | A | 8/1966 | Owen |
| 3,298,437 | A | 1/1967 | Conrad |
| 3,327,630 | A | 6/1967 | Bell |
| 3,357,355 | A | 12/1967 | Roush |
| 3,361,204 | A | 1/1968 | Howard et al. |
| 3,366,179 | A | 1/1968 | Kinley et al. |
| 3,398,803 | A | 8/1968 | Kurt et al. |
| 3,498,376 | A | 3/1970 | Sizer et al. |
| 3,630,284 | A | 12/1971 | Fast et al. |
| 3,691,954 | A | 9/1972 | Kern |
| 3,712,376 | A | 1/1973 | Young et al. |
| 3,731,626 | A | 5/1973 | Grayson |
| 3,762,470 | A | 10/1973 | Eggleston |
| 3,777,663 | A | 12/1973 | Brown |
| 3,892,455 | A | 7/1975 | Sotolongo |
| 4,003,433 | A | 1/1977 | Goins |
| 4,024,817 | A | 5/1977 | Calder, Jr. et al. |
| 4,039,239 | A | 8/1977 | Cobaugh et al. |
| 4,063,512 | A | 12/1977 | Davis |
| 4,064,935 | A | 12/1977 | Mohaupt |
| 4,080,902 | A | 3/1978 | Goddard et al. |
| 4,099,464 | A | 7/1978 | Cross et al. |
| 4,107,453 | A | 8/1978 | Erixon |
| 4,109,576 | A | 8/1978 | Eckels |
| 4,132,171 | A | 1/1979 | Pawlak et al. |
| 4,172,421 | A | 10/1979 | Regalbuto |
| 4,191,265 | A | 3/1980 | Bosse-Platiere |
| 4,220,087 | A | 9/1980 | Posson |
| 4,250,960 | A | 2/1981 | Chammas |
| 4,269,120 | A | 5/1981 | Brede et al. |
| 4,290,486 | A | 9/1981 | Regalbuto |
| 4,312,273 | A | 1/1982 | Camp |
| 4,317,413 | A | 3/1982 | Strandli et al. |
| 4,319,526 | A | 3/1982 | DerMott |
| 4,346,954 | A | 8/1982 | Appling |
| 4,363,529 | A | 12/1982 | Loose |
| 4,429,741 | A | 2/1984 | Hyland |
| 4,455,941 | A | 6/1984 | Walker et al. |
| 4,485,741 | A | 12/1984 | Moore et al. |
| 4,530,396 | A | 7/1985 | Mohaupt |
| 4,534,423 | A | 8/1985 | Regalbuto |
| 4,537,132 | A | 8/1985 | Sabranski et al. |
| 4,583,602 | A | 4/1986 | Ayers |
| 4,609,056 | A | 9/1986 | Colle, Jr. et al. |
| 4,609,057 | A | 9/1986 | Walker et al. |
| 4,617,997 | A | 10/1986 | Jennings, Jr. |
| 4,619,318 | A | 10/1986 | Terrell et al. |
| 4,619,333 | A | 10/1986 | George |
| 4,620,591 | A | 11/1986 | Terrell et al. |
| 10,000,994 | B1 | 6/2018 | Sites |
| 10,001,007 | B2 | 6/2018 | Pelletier et al. |
| 10,036,236 | B1 | 7/2018 | Sullivan et al. |
| 10,041,321 | B2 | 8/2018 | Oag et al. |
| 10,047,591 | B2 | 8/2018 | Bell et al. |
| 10,047,592 | B2 | 8/2018 | Burgos et al. |
| 10,053,968 | B2 | 8/2018 | Tolman et al. |
| 10,054,414 | B2 | 8/2018 | Scheid et al. |
| 10,066,921 | B2 | 9/2018 | Eitschberger |
| 10,077,626 | B2 | 9/2018 | Xu et al. |
| 10,087,708 | B2 | 10/2018 | Al-Gouhi et al. |
| 10,107,054 | B2 | 10/2018 | Drury et al. |
| 10,138,713 | B2 | 11/2018 | Tolman et al. |
| 10,151,152 | B2 | 12/2018 | Wight et al. |
| 10,151,180 | B2 | 12/2018 | Robey et al. |
| 10,151,181 | B2 | 12/2018 | Lopez et al. |
| 10,167,691 | B2 | 1/2019 | Zhang et al. |
| 10,174,595 | B2 | 1/2019 | Knight et al. |
| 10,180,050 | B2 | 1/2019 | Hardesty |
| 10,184,327 | B2 | 1/2019 | Skyler |
| 10,196,886 | B2 | 2/2019 | Tolman et al. |
| 10,208,573 | B2 | 2/2019 | Kaenel et al. |
| 10,240,441 | B2 | 3/2019 | Geerts et al. |
| 10,246,952 | B2 | 4/2019 | Trydal et al. |
| 10,267,127 | B2 | 4/2019 | Geerts et al. |
| 10,267,603 | B2 | 4/2019 | Marshall et al. |
| 10,287,873 | B2 | 5/2019 | Filas et al. |
| 10,301,910 | B2 | 5/2019 | Whitsitt et al. |
| 10,321,594 | B2 | 6/2019 | Zhu et al. |
| 10,323,484 | B2 | 6/2019 | Liess |
| 10,337,270 | B2 | 7/2019 | Carisella et al. |
| 10,337,301 | B2 | 7/2019 | Harive |
| 10,358,880 | B2 | 7/2019 | Metcalf et al. |
| 10,365,079 | B2 | 7/2019 | Harrington et al. |
| 10,422,195 | B2 | 9/2019 | LaGrange et al. |
| 10,428,595 | B2 | 10/2019 | Bradley et al. |
| 10,429,161 | B2 | 10/2019 | Parks et al. |
| 10,458,213 | B1 | 10/2019 | Eitschberger et al. |
| 10,465,488 | B2 | 11/2019 | Collins et al. |
| 10,472,901 | B2 | 11/2019 | Engel et al. |
| 10,472,938 | B2 | 11/2019 | Parks et al. |
| 10,488,163 | B2 | 11/2019 | Collins et al. |
| 10,584,565 | B2 | 3/2020 | Golian et al. |
| 10,605,018 | B2 | 3/2020 | Schmidt et al. |
| 10,669,822 | B2 | 6/2020 | Eitschberger |
| 10,677,026 | B2 | 6/2020 | Sokolove et al. |
| 10,731,443 | B2 | 8/2020 | Kaenel et al. |
| 10,739,115 | B2 | 8/2020 | Loehken et al. |
| 11,053,782 | B2 | 7/2021 | Loehken et al. |
| 11,339,632 | B2 | 5/2022 | Eitschberger et al. |

(56) References Cited

U.S. PATENT DOCUMENTS

2001/0052303 A1 12/2001 Mayseless et al.
2002/0017214 A1 2/2002 Jacoby et al.
2002/0036101 A1 3/2002 Huhdanmaki et al.
2002/0040783 A1 4/2002 Zimmerman et al.
2002/0129940 A1 9/2002 Yang et al.
2002/0129941 A1 9/2002 Alves et al.
2002/0134552 A1 9/2002 Moss
2002/0189482 A1 12/2002 Kneisl et al.
2003/0001753 A1 1/2003 Cernocky et al.
2003/0155112 A1 8/2003 Tiernan et al.
2003/0183113 A1 10/2003 Barlow et al.
2004/0094305 A1 5/2004 Skjærseth et al.
2004/0141279 A1 7/2004 Amano et al.
2004/0211862 A1 10/2004 Elam
2004/0216632 A1 11/2004 Finsterwald
2004/0239521 A1 12/2004 Zierolf
2005/0011645 A1 1/2005 Aronstam et al.
2005/0103526 A1 5/2005 Ayling
2005/0115448 A1 6/2005 Pratt et al.
2005/0183610 A1 8/2005 Barton et al.
2005/0186823 A1 8/2005 Ring et al.
2005/0194146 A1 9/2005 Barker et al.
2005/0217844 A1 10/2005 Edwards et al.
2005/0218260 A1 10/2005 Corder et al.
2005/0229805 A1 10/2005 Myers, Jr. et al.
2005/0257710 A1 11/2005 Monetti et al.
2005/0269083 A1 12/2005 Burris, II et al.
2006/0013282 A1 1/2006 Hanzawa et al.
2006/0054326 A1 3/2006 Alves et al.
2006/0075890 A1 4/2006 Tiernan
2006/0081374 A1 4/2006 Bland et al.
2006/0082152 A1 4/2006 Neves
2007/0079966 A1 4/2007 George et al.
2007/0084336 A1 4/2007 Neves
2007/0125540 A1 6/2007 Gerez et al.
2007/0158071 A1 7/2007 Mooney, Jr. et al.
2007/0267195 A1 11/2007 Grigar et al.
2008/0047456 A1 2/2008 Li et al.
2008/0047716 A1 2/2008 McKee et al.
2008/0110612 A1 5/2008 Prinz et al.
2008/0110632 A1 5/2008 Beall
2008/0121095 A1 5/2008 Han et al.
2008/0134922 A1 6/2008 Grattan et al.
2008/0223587 A1 9/2008 Cherewyk
2008/0264639 A1 10/2008 Parrott et al.
2009/0050321 A1 2/2009 Rhodes et al.
2009/0151949 A1 6/2009 Marya et al.
2009/0159283 A1 6/2009 Fuller et al.
2009/0159285 A1 6/2009 Goodman
2009/0183916 A1 7/2009 Pratt et al.
2009/0211760 A1 8/2009 Richards et al.
2009/0255728 A1 10/2009 Spencer et al.
2009/0272519 A1 11/2009 Green et al.
2009/0301723 A1 12/2009 Gray
2009/0308589 A1 12/2009 Bruins et al.
2010/0000789 A1 1/2010 Barton et al.
2010/0012774 A1 1/2010 Fanucci et al.
2010/0022125 A1 1/2010 Burris et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Nölke et al.
2010/0288496 A1 11/2010 Cherewyk
2010/0307773 A1 12/2010 Tinnen et al.
2011/0005777 A1 1/2011 Meff
2011/0024116 A1 2/2011 McCann et al.
2011/0042069 A1 2/2011 Bailey et al.
2011/0094406 A1 4/2011 Marya et al.
2011/0155013 A1 6/2011 Boyer et al.
2011/0209871 A1 9/2011 Le et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0152542 A1 6/2012 Le
2012/0160483 A1 6/2012 Carisella
2012/0160491 A1 6/2012 Goodman et al.
2012/0180678 A1 7/2012 Kneisl
2012/0199031 A1 8/2012 Lanclos
2012/0241169 A1 9/2012 Hales et al.
2012/0242135 A1 9/2012 Thomson et al.
2012/0247771 A1 10/2012 Black et al.
2013/0008639 A1 1/2013 Tassaroli et al.
2013/0043074 A1 2/2013 Tassaroli
2013/0048376 A1 2/2013 Rodgers et al.
2013/0056208 A1 3/2013 Xu
2013/0062055 A1 3/2013 Tolman et al.
2013/0118342 A1 5/2013 Tassaroli
2013/0118805 A1 5/2013 Moody-Stuart et al.
2013/0168083 A1 7/2013 McCarter et al.
2013/0199843 A1 8/2013 Ross
2013/0228326 A1 9/2013 Griffith et al.
2013/0248174 A1 9/2013 Dale et al.
2013/0256464 A1 10/2013 Belik et al.
2013/0327571 A1 12/2013 Andrzejak
2014/0000877 A1 1/2014 Robertson et al.
2014/0026776 A1 1/2014 Kecskes et al.
2014/0033939 A1 2/2014 Priess et al.
2014/0053750 A1 2/2014 Lownds et al.
2014/0060839 A1 3/2014 Wang et al.
2014/0061376 A1 3/2014 Fisher et al.
2014/0083774 A1 3/2014 Hoult et al.
2014/0127941 A1 5/2014 Lu
2014/0131035 A1 5/2014 Entchev et al.
2014/0138090 A1 5/2014 Hill et al.
2014/0148044 A1 5/2014 Balcer et al.
2014/0166370 A1 6/2014 Silva
2014/0209381 A1 7/2014 Huang et al.
2014/0218207 A1 8/2014 Gano et al.
2014/0314977 A1 10/2014 Weinhold
2014/0360720 A1 12/2014 Corbeil
2015/0041124 A1 2/2015 Rodriguez
2015/0114626 A1 4/2015 Hatten et al.
2015/0167410 A1 6/2015 Garber et al.
2015/0176386 A1 6/2015 Castillo et al.
2015/0209954 A1 7/2015 Hokanson
2015/0226533 A1 8/2015 Grattan
2015/0247375 A1 9/2015 Stout
2015/0275615 A1 10/2015 Rytlewski et al.
2015/0316360 A1 11/2015 Hinton et al.
2015/0354310 A1 12/2015 Zaiser
2015/0356403 A1 12/2015 Storm, Jr.
2015/0361774 A1 12/2015 Flores
2015/0376991 A1 12/2015 Mcnelis et al.
2016/0040502 A1 2/2016 Robben
2016/0040520 A1 2/2016 Tolman et al.
2016/0053560 A1 2/2016 Drury et al.
2016/0069163 A1 3/2016 Tolman et al.
2016/0084048 A1 3/2016 Harrigan et al.
2016/0108722 A1 4/2016 Whitsitt et al.
2016/0115741 A1 4/2016 Davis
2016/0144734 A1 5/2016 Wang et al.
2016/0145990 A1 5/2016 Mace et al.
2016/0153267 A1 6/2016 Walker et al.
2016/0153271 A1 6/2016 Mace et al.
2016/0153272 A1 6/2016 Mace et al.
2016/0168961 A1 6/2016 Parks et al.
2016/0186511 A1 6/2016 Coronado et al.
2016/0186513 A1 6/2016 Robertson et al.
2016/0202027 A1 7/2016 Peterson et al.
2016/0215592 A1 7/2016 Helms et al.
2016/0223171 A1 8/2016 Gibbons et al.
2016/0258240 A1 9/2016 Fripp et al.
2016/0290084 A1 10/2016 LaGrange et al.
2016/0290098 A1 10/2016 Marya
2016/0298404 A1 10/2016 Beckett et al.
2016/0356132 A1 12/2016 Burmeister et al.
2017/0009559 A1 1/2017 Spring
2017/0030162 A1 2/2017 Carragher
2017/0030693 A1 2/2017 Preiss et al.
2017/0032653 A1 2/2017 Crawford et al.
2017/0037716 A1 2/2017 Kohlik

(56) References Cited

U.S. PATENT DOCUMENTS

2017/0044865 A1 2/2017 Sabins et al.
2017/0044875 A1 2/2017 Hebebrand et al.
2017/0052004 A1 2/2017 Xue
2017/0052011 A1 2/2017 Parks et al.
2017/0058648 A1 3/2017 Geerts et al.
2017/0058649 A1 3/2017 Geerts et al.
2017/0067303 A1 3/2017 Thiemann et al.
2017/0067320 A1 3/2017 Zouhair et al.
2017/0074078 A1 3/2017 Eitschberger
2017/0138150 A1 5/2017 Yencho
2017/0159379 A1 6/2017 Metcalf et al.
2017/0167233 A1 6/2017 Sampson et al.
2017/0175488 A1 6/2017 Lisowski et al.
2017/0175500 A1 6/2017 Robey et al.
2017/0199015 A1 7/2017 Collins et al.
2017/0204687 A1 7/2017 Yorga et al.
2017/0226814 A1 8/2017 Clemens et al.
2017/0241244 A1 8/2017 Barker et al.
2017/0268320 A1 9/2017 Angman et al.
2017/0268326 A1 9/2017 Tao et al.
2017/0268860 A1 9/2017 Eitschberger
2017/0275976 A1 9/2017 Collins et al.
2017/0276465 A1 9/2017 Parks et al.
2017/0298716 A1 10/2017 McConnell et al.
2017/0306710 A1 10/2017 Trydal et al.
2017/0314372 A1 11/2017 Tolman et al.
2017/0314373 A9 11/2017 Bradley et al.
2017/0328134 A1 11/2017 Sampson et al.
2017/0328160 A1 11/2017 Arnaly
2017/0335646 A1 11/2017 Huang et al.
2017/0357021 A1 12/2017 Valero et al.
2018/0002999 A1 1/2018 Johnson
2018/0003038 A1 1/2018 Cherewyk
2018/0003045 A1 1/2018 Dotson et al.
2018/0030334 A1 2/2018 Collier et al.
2018/0038208 A1 2/2018 Eitschberger et al.
2018/0080298 A1 3/2018 Covalt et al.
2018/0080300 A1 3/2018 Angstmann et al.
2018/0087330 A1 3/2018 Bradley et al.
2018/0087369 A1 3/2018 Sherman et al.
2018/0106121 A1 4/2018 Griffin et al.
2018/0119529 A1 5/2018 Goyeneche
2018/0120066 A1 5/2018 Khatiwada et al.
2018/0127641 A1 5/2018 Nguyen et al.
2018/0135398 A1 5/2018 Entchev et al.
2018/0148995 A1 5/2018 Burky et al.
2018/0156029 A1 6/2018 Harrison et al.
2018/0163497 A1 6/2018 Younger
2018/0171757 A1 6/2018 Xu
2018/0202248 A1 7/2018 Harrington et al.
2018/0202249 A1 7/2018 Harrington et al.
2018/0202779 A1* 7/2018 McNelis ..... F42B 1/036
2018/0202789 A1 7/2018 Parks et al.
2018/0202790 A1 7/2018 Parks et al.
2018/0209250 A1 7/2018 Daly et al.
2018/0209251 A1 7/2018 Robey et al.
2018/0238132 A1 8/2018 Oag et al.
2018/0252054 A1 9/2018 Stokes
2018/0252507 A1 9/2018 Collier
2018/0274356 A1 9/2018 Hazel
2018/0283836 A1 10/2018 Thomas
2018/0291715 A1 10/2018 Barker
2018/0299239 A1 10/2018 Eitschberger et al.
2018/0305993 A1 10/2018 Perkins et al.
2018/0306010 A1 10/2018 Von Kaenel et al.
2018/0313182 A1 11/2018 Cherewyk et al.
2018/0318770 A1 11/2018 Eitschberger et al.
2018/0340412 A1 11/2018 Singh et al.
2018/0347324 A1 12/2018 Langford et al.
2018/0355674 A1 12/2018 Cooper et al.
2018/0363424 A1 12/2018 Schroeder et al.
2019/0031307 A1 1/2019 Siersdorfer
2019/0032470 A1 1/2019 Harrigan
2019/0040722 A1 2/2019 Yang et al.
2019/0048693 A1 2/2019 Henke et al.
2019/0049225 A1 2/2019 Eitschberger
2019/0085664 A1 3/2019 Hardesty et al.
2019/0085685 A1 3/2019 McBride
2019/0106962 A1 4/2019 Lee et al.
2019/0128657 A1 5/2019 Harrington et al.
2019/0136673 A1 5/2019 Sullivan et al.
2019/0153827 A1 5/2019 Goyeneche
2019/0162055 A1 5/2019 Collins et al.
2019/0162056 A1 5/2019 Sansing
2019/0162057 A1 5/2019 Montoya Ashton et al.
2019/0186211 A1 6/2019 Gonzalez
2019/0195054 A1 6/2019 Bradley et al.
2019/0211655 A1 7/2019 Bradley et al.
2019/0218880 A1 7/2019 Cannon et al.
2019/0219375 A1 7/2019 Parks et al.
2019/0234188 A1 8/2019 Goyeneche
2019/0242222 A1 8/2019 Eitschberger
2019/0257158 A1 8/2019 Langford et al.
2019/0257181 A1 8/2019 Langford et al.
2019/0264548 A1 8/2019 Zhao et al.
2019/0277103 A1 9/2019 Wells et al.
2019/0284889 A1 9/2019 LaGrange et al.
2019/0292887 A1 9/2019 Austin et al.
2019/0316449 A1 10/2019 Schultz et al.
2019/0330947 A1 10/2019 Mulhern et al.
2019/0330961 A1 10/2019 Knight et al.
2019/0338606 A1 11/2019 Metcalf et al.
2019/0338612 A1 11/2019 Holodnak et al.
2019/0353015 A1 11/2019 LaGrange et al.
2019/0366272 A1 12/2019 Eitschberger et al.
2019/0368293 A1 12/2019 Covalt et al.
2019/0368301 A1 12/2019 Eitschberger et al.
2019/0368319 A1 12/2019 Collins et al.
2019/0368331 A1 12/2019 Vick, Jr. et al.
2020/0018132 A1 1/2020 Ham
2020/0024934 A1 1/2020 Eitschberger et al.
2020/0024935 A1 1/2020 Eitschberger et al.
2020/0032626 A1 1/2020 Parks et al.
2020/0048996 A1 2/2020 Anthony et al.
2020/0063537 A1 2/2020 Langford et al.
2020/0063553 A1 2/2020 Zemla et al.
2020/0072029 A1 3/2020 Anthony et al.
2020/0088011 A1 3/2020 Eitschberger et al.
2020/0095838 A1 3/2020 Baker
2020/0182025 A1 6/2020 Brady
2020/0217635 A1 7/2020 Eitschberger
2020/0248535 A1 8/2020 Goyeneche
2020/0248536 A1 8/2020 Holodnak et al.
2020/0256166 A1 8/2020 Knight et al.
2020/0256168 A1 8/2020 Knight et al.
2020/0284104 A1 9/2020 Holmberg et al.
2020/0378737 A1* 12/2020 Loehken ..... E21B 43/119
2021/0238966 A1 8/2021 Preiss et al.

FOREIGN PATENT DOCUMENTS

WO 2005103602 A2 11/2005
WO WO-2014179689 A1 * 11/2014 ..... E21B 43/117
WO 2016161376 A1 10/2016
WO 2017029240 A1 2/2017
WO 2018231847 A1 12/2018
WO 2019105721 A1 6/2019
WO 2019117874 A1 6/2019

OTHER PUBLICATIONS

Dynaenergetics, Dynaslot System 360° Certainty Well Abandonment, Product Brochure, 6 pgs., https://www.dynaenergetics.com/en/products/hardware-and-tcp/perforating-gun-systems/dynaslot-gun-system.

International Searching Authority; International Search Report and Written Opinion of the International Searching Authority for PCT/EP2021/063761; mailed on Nov. 24, 2021; 18 pages.

Schlumberger; PowerSprial Nova Extradeep spiral-phased capsule gun perforating system Press Release; dated Oct. 22, 2020; Retrieved from web on Jaunary 18, 2021; https://www.slb.com/completions/

(56) References Cited

OTHER PUBLICATIONS well-completions/perforating/perforating-guns-and-charges/powerspiral-nova-capsule-gun-perforating-system; 2 pages.
U.S. Appl. No. 29/722,460, filed Jan. 30, 2020, Christian Eitschberger.
U.S. Appl. No. 29/722,461, filed Jan. 30, 2020, Christian Eitschberger.
U.S. Appl. No. 29/748,612, filed Aug. 31, 2020, Christian Eitschberger.

* cited by examiner

PERFORATING GUN ASSEMBLY AND COMPONENTS

CROSS-REFERENCE TO RELATED APPLICATIONS

This application is a 371 Application of International Application PCT/EP2021/063761 filed May 24, 2021, which claims the benefit of and priority to U.S. Provisional Patent Application No. 63/157,037 filed Mar. 5, 2021, U.S. Provisional Patent Application No. 63/135,944 filed Jan. 11, 2021 and U.S. Provisional Patent Application No. 63/135,009 filed Jan. 8, 2021, the entire contents of which are incorporated herein by reference.

BACKGROUND

Oil and gas well completion processes include perforating a hydrocarbon formation to liberate the oil and gas within reservoirs therein. Hydrocarbon formations may include, for example, subterranean oil and gas shale formations, sandstone formations, and/or carbonate formations. Perforating guns perform the perforating operations. The perforating guns carry explosive charges, i.e., "shaped charges", into a wellbore that has been drilled into the hydrocarbon formation. The shaped charges detonate, and an explosive jet formed by each shaped charge may perforate one or more of a structure surrounding the shaped charge or perforating gun within the wellbore, a layer of cement surrounding the wellbore, and the hydrocarbon formation. For example, the wellbore may include cemented-in casing pipes and other tubulars (collectively, "wellbore casing") that isolate an environment within the wellbore from the hydrocarbon formation prior to perforating. For brevity within this disclosure, the term "wellbore" refers to the drilled wellbore and any wellbore casing therein, except where otherwise specified.

The shape and configuration of the shaped charge and resulting explosive jet may vary depending on operational requirements. For example, abandonment procedures for decommissioned wells include permanently sealing the wellbore using cement. Unwanted vertical channels or voids may exist in a previously cemented wellbore annulus between the wellbore casing and the hydrocarbon formation and may produce migration pathways for fluids or gas to contaminate surrounding areas. The problem of migration pathways within the wellbore annulus can be solved with a "cement squeeze" operation. A "cement squeeze" operation uses perforating guns to perforate through the wellbore casing, but not necessarily into the hydrocarbon formation, to access the wellbore annulus via perforations through which cement is squeezed, under pressure, into the wellbore annulus. A goal for typical cement squeeze operations is for perforations to provide 360-degree access from within the wellbore casing to the wellbore annulus, to increase the coverage of cement in the annulus. Accordingly, a conventional perforating gun for a cement squeeze operation may include a helical arrangement of overlapping "slotted" shaped charges that are rectangularly-shaped and produce rectangularly-shaped perforations. The rectangular shape allows the long portions of the rectangular perforations to overlap and thereby provide 360-degree access.

The wellbore casing may also be filled with a wellbore fluid, which requires the use of a perforating gun system having components, such as shaped charges, that are sealed against the wellbore fluid. These shaped charges are typically referred to as encapsulated shaped charges. The shaped charges must be sealed and protected against the wellbore fluids and hydraulic pressures within the wellbore. For example, in a typical "gun carrier"-type perforating gun, the shaped charges are retained and oriented in a charge carrier, such as a metal tube, housed with other perforating gun components within a sealed interior chamber of, e.g., a cylindrical gun housing such as a metal tube. The shaped charges are typically secured in the charge carrier or charge tube to prevent the shaped charges from being detached from the charge carrier and potentially lost in the wellbore. Components within the sealed interior chamber need not be individually protected, but the shaped charge explosive jets must penetrate the gun housing in addition to, e.g., the wellbore casing.

Alternatively, a typical "exposed" perforating gun includes shaped charges retained and oriented in a charge carrier that is exposed to the wellbore environment. The shaped charges must be individually protected against the wellbore environment, but the explosive jets need not first penetrate a gun housing, nor is the extra material, weight, machining, or cost a gun housing required. The shaped charges are typically protected by, among other things, sealing the interior of each shaped charge, including the explosive components, with a charge lid that covers and seals an open end of the shaped charge. The charge lid protects the components during normal use, but the sealed interior may present safety risks if, for example, the sealed charge is exposed to fire and the heat therefrom causes a buildup of gas pressure from the explosive within.

It is important to maintain an appropriate distance (i.e., standoff) between the shaped charge and the inner surface of the lid to be penetrated in order to ensure that the shaped charge can fully create the perforating jet before the perforating jet exits the perforating gun. Adjusting the distance between the shaped charge lid and the target formation, e.g. the clearance, may be desirable for penetrating the casing and/or the target formation according to goals for particular operations.

For at least the above reasons, a need exists for a shaped charge carrier that orients shaped charges in a desired perforating direction so that the shaped charges overlap each other along a length of the perforating gun. A further need exists for a shaped charge carrier that optimizes the distance of shaped charges from a target formation. There is a further need for a shaped charge holder that secures shaped charges in a shaped charge carrier.

BRIEF SUMMARY

Embodiments of the present disclosure may be associated with a jacket for housing a shaped charge. In some embodiments, the jacket includes a back wall, a top wall and a bottom wall spaced apart from the top wall, a first sidewall extending from the back wall and between the top wall and bottom wall, and a second sidewall spaced apart from the first sidewall, and extending from the back wall and between the top wall and bottom wall. An internal cavity is defined by the back wall, the top wall, the bottom wall, the first sidewall and the second sidewall. According to an aspect, the internal cavity is configured to receive the shaped charge. A retention latch may extend from an internal surface of at least one of the top wall, the bottom wall, the first sidewall and the second sidewall. The retention latch extends toward the internal cavity and is configured to secure the shaped charge within the internal cavity.

Further embodiments of the disclosure may be associated with a perforating gun assembly. In some embodiments, the perforating gun assembly includes a shaped charge carrier having a wall and at least one shaped charge receptacle extending through the wall. According to an aspect, an orientation slot is formed into a peripheral edge portion of the at least one shaped charge receptacle. A jacket may be positioned in the at least one shaped charge receptacle. According to an aspect, the jacket includes a key that is configured for being received within the orientation slot.

Additional embodiments of the disclosure are associated with a tool string for deployment into a wellbore. In some embodiments, the tool string includes a first shaped charge carrier and a second shaped charge carrier. Each of the first shaped charge carrier and the second shaped charge carrier includes a wall, at least one shaped charge receptacle extending through the wall, and an orientation slot formed into a peripheral edge portion of the at least one shaped charge receptacle. A jacket is positioned in the at least one shaped charge receptacle of the first shaped charge carrier and the second shaped charge carrier. The jacket includes a key that is receivable in the orientation slot. A shaped charge may be positioned in the jacket. The tool string further includes a connector extending between the first shaped charge carrier and the second shaped charge carrier. The connector is configured for orienting the first shaped charge carrier relative to the second shaped charge carrier.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
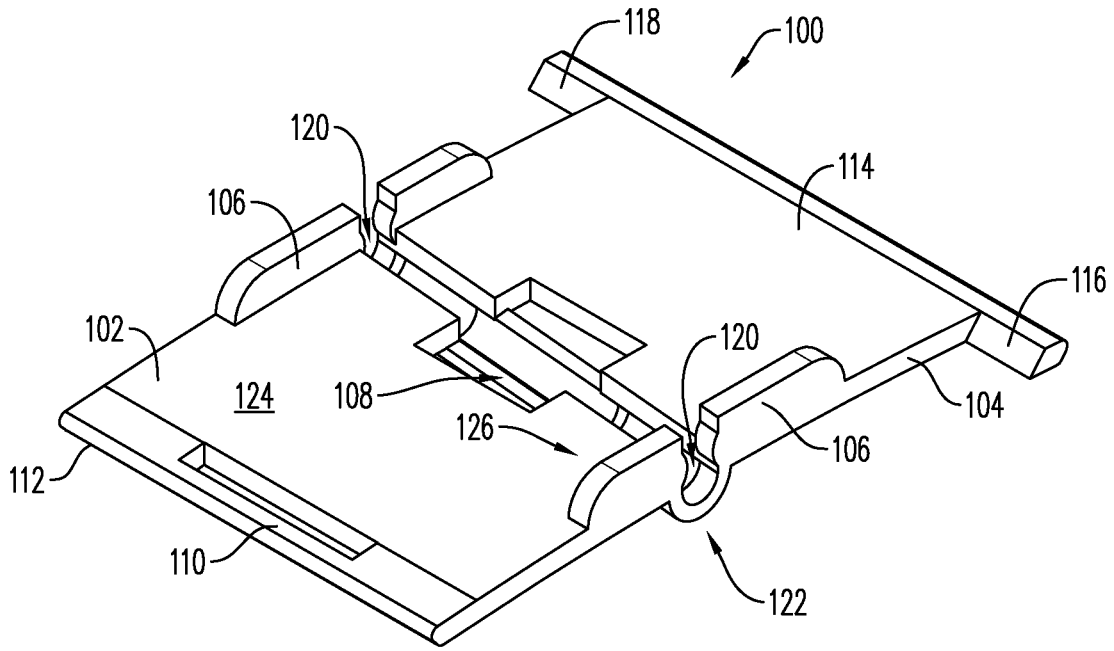
FIG. 1 illustrates a perspective view of an inlay, in accordance with an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

With reference to FIGS. 1-4, the exemplary embodiments relate to a shaped charge holder/shaped inlay 100. The inlay 100 may be configured as a generally planar/flat structure with one or more contours to help affix a shaped charge, such as a rectangular or slotted shaped charge, to the inlay 100. For example, the inlay 100 can be configured to form a surface upon which the slotted shaped charge is positioned when the slotted shaped charge is positioned in a shaped charge carrier. This surface allows or accommodates the slotted shaped charge in a desired radial position for a perforating gun.

According to an aspect, the inlay includes a first wing portion 102 and a second wing portion 104. The first wing portion 102 includes a slot 110 provided adjacent a first wing outer edge 112. As described further below, the slot 110 may be configured to receive a portion of a shaped charge carrier 500 so that the inlay 100 and the slotted shaped charge positioned on an upper surface 124 of the inlay 100 are secured within the shaped charge carrier 500. The second wing portion 104 includes a limit stop 114, which may help to position the inlay 100 in a desired position within the shaped charge carrier 500. The limit stop 114 may help to limit the movement of the inlay 100 within the shaped charge carrier 500. The limit stop 114 may be provided along an outer edge of the second wing portion 104 and include a first end 116 that extends away from the second wing portion 104 and a second end 118 that is spaced apart from the first end 116 and extends away from the second wing portion 104.

Figure 2:
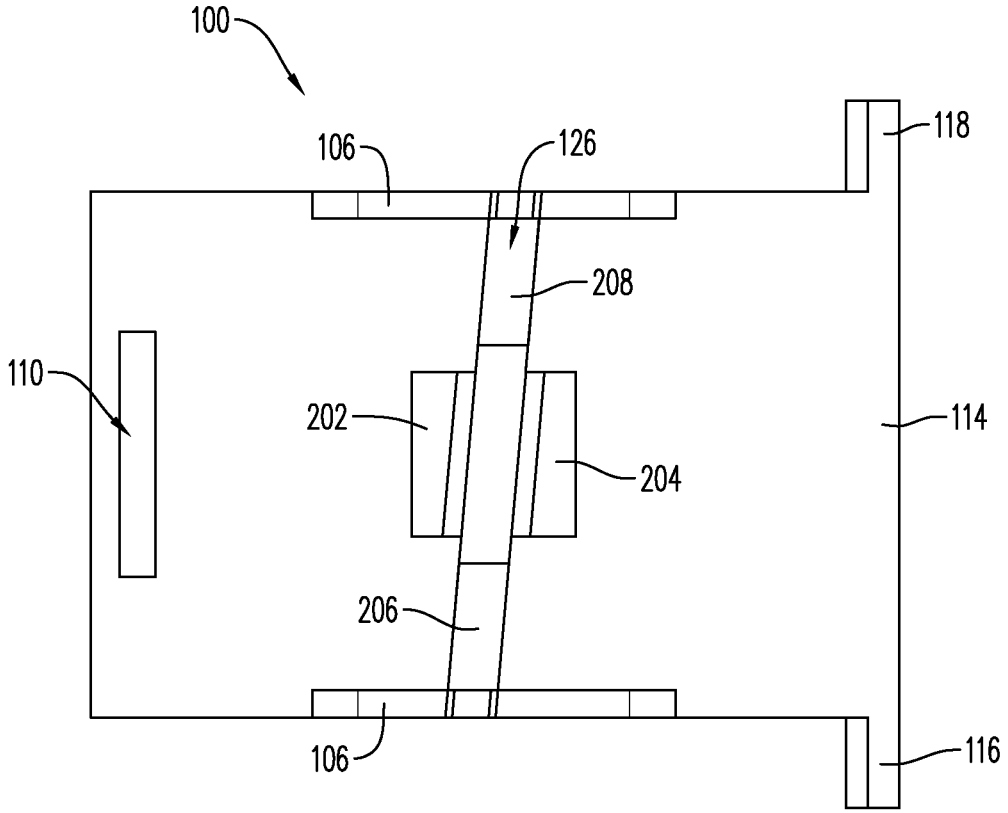
FIG. 2 illustrates a top view of an inlay, in accordance with an embodiment.
Figure 3:
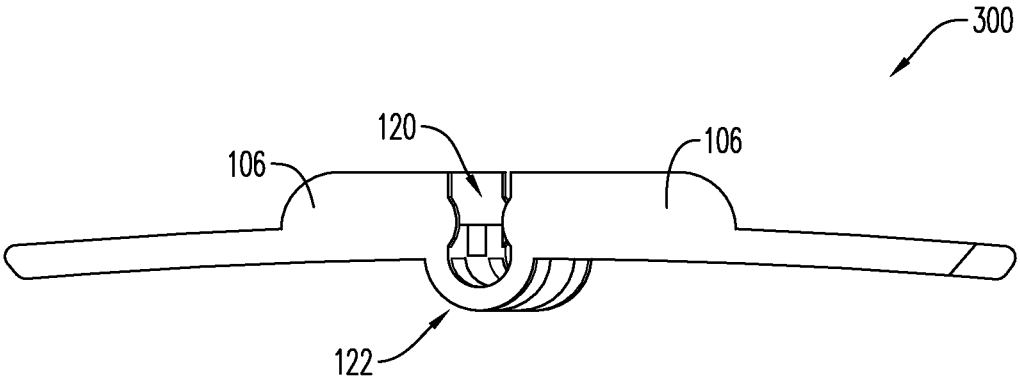
FIG. 3 illustrates a front view of an inlay, in accordance with an embodiment.
Figure 4:
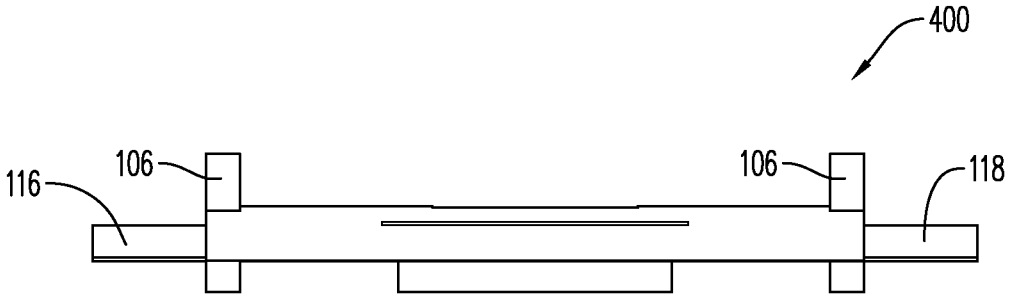
FIG. 4 illustrates a left-side view of an inlay, in accordance with an embodiment.

As shown in FIG. 1, FIG. 2, and FIG. 3, the inlay 100 may include a sidewall 106 extending upwardly from the upper surface 124. According to an aspect, the sidewall 106 extends in a direction that is perpendicular to the upper surface 124 of the inlay 100. The inlay 100 may include a pair of sidewalls 106, with each sidewall of the pair of sidewalls 106 being spaced apart from each other. When a shaped charge is positioned on the upper surface 124 of the inlay 100, the shaped charge may be flanked, or positioned in between each sidewall of the pair of sidewalls 106. The sidewalls 106 may help to fix the shaped charge in an axial direction in the charge carrier, by virtue of its position on the upper surface 124 of the inlay 100.

According to an aspect and as illustrated in FIG. 2 and FIG. 3, each sidewall 106 is segmented (i.e., a gap/recess is formed in each sidewall 106). The gap may be configured to receive at least a portion of a detonating cord 910 traversing the inlay 100 and ballistically connected to each shaped charge. In an aspect, a first pair of sidewalls 106 is provided on the first wing portion 102 and a second pair of sidewalls 106 is provided on the second wing portion 104.

In some embodiments, a detonating cord receptacle 122 extends between the first wing portion 102 and the second wing portion 104. The detonating cord receptacle 122 can include a channel 108 defined by a detonating cord retainer 126, which hosts and fixes the detonating cord 910. As illustrated in FIG. 2, the detonating cord receptacle 122 may be oriented in a slanted configuration (e.g., not parallel to the limit stop 114 on the second wing portion 104). It is contemplated that the slanted configuration may help orient the detonating cord in a generally helical configuration along the length of a shaped charge carrier 500.

One or more openings formed in the first wing portion 102 and the second wing portion 104 may flank the sides of the channel 108 of the detonating cord receptacle 122. According to an aspect, the one or more openings include a first opening 202, a second opening 204, a third opening 206 and a fourth opening 208. Each opening of the first opening 202, the second opening 204, the third opening 206 and the fourth opening 208 may be spaced apart from other openings in the inlay 100. As shown in FIG. 2, the channel 108 extends between the first wing portion 102 and the second wing portion 104, with first opening 202 and the second opening 204 flanking the channel 108. The third opening 206 and the fourth opening 208 may extend in the direction of the detonating cord retainer 126.

The channel 108 may be at least partially defined by a detonating cord retainer wall, which hosts and fixes the detonating cord 910 within the channel 108. In some embodiments, the channel 108 extends between the recesses formed in the sidewall 106 on each side of the upper surface 124, and each end of the channel 108 is defined by the detonating cord receptacle 122 into which the detonating cord 910 can be fixed. The detonating cord 910 may be positioned or placed into the inlay 100, from above the upper surface 124 of the inlay 100. After the detonating cord 910 is secured in the detonating cord receptacle 122, below the upper surface 124 of the inlay 100, the shaped charge may be positioned on the upper surface 124 of the inlay 100. The detonating cord 910 may be positioned in or pressed into the largest slot or opening in the shaped charge carrier 500 before the slotted shaped charge is arranged into a shaped charge receptacle 516 of the shaped charge carrier 500.

The inlay 100 may be formed from a flexible material, such that the inlay 100 may temporarily bend in order to fit in a desired location. According to an aspect, the inlay 100 may be formed from plastic. The inlay 100 may be formed using injection molding or 3D-printing methods. According to an aspect, the inlay 100 may be formed from steel. For instance, a steel plate may be bent and stamped in order to form the contours and various openings of the inlay 100.

With reference to FIGS. 5-8, the exemplary embodiments relate to a shaped charge carrier 500. The shaped charge carrier 500 may be configured as a generally cylindrical structure having one or more slots and openings formed in a wall 514 of the shaped charge carrier 500. A shaped charge receptacle 516 extends through the wall 514 of the shaped charge carrier 500 and is configured to orient the shaped charge in a radial direction (along an x-axis of the carrier). The shaped charge receptacle 516 may be configured as a square or a rectangular opening with four wall surfaces. One or more of the wall surfaces may include a tab 502, tab 504 that bends or flexes in order to receive the slotted shaped charge. The tab 502, tab 504 may be re-aligned by bending the tab 502, tab 504 into the desired position using a tool, such as a flat-headed screwdriver. According to an aspect, the shaped charge carrier 500 also includes one or more inlay guide/inlay retention slots 510 or openings (e.g. in the wall 514) formed opposite the location of the shaped charge receptacle 516, in the axial direction (x-axis) of the shaped charge carrier 500. The inlay retention slot 510 may include at least one tab 512 that bends or flexes in order to receive the inlay 100. According to an aspect, the tab 512 of the shaped charge carrier 500 may be positioned in the inlay retention slot 510 to secure the inlay 100 in the shaped charge carrier 500 and prevent tangential movement of the inlay 100 relative to the shaped charge carrier 500.

Figure 5:
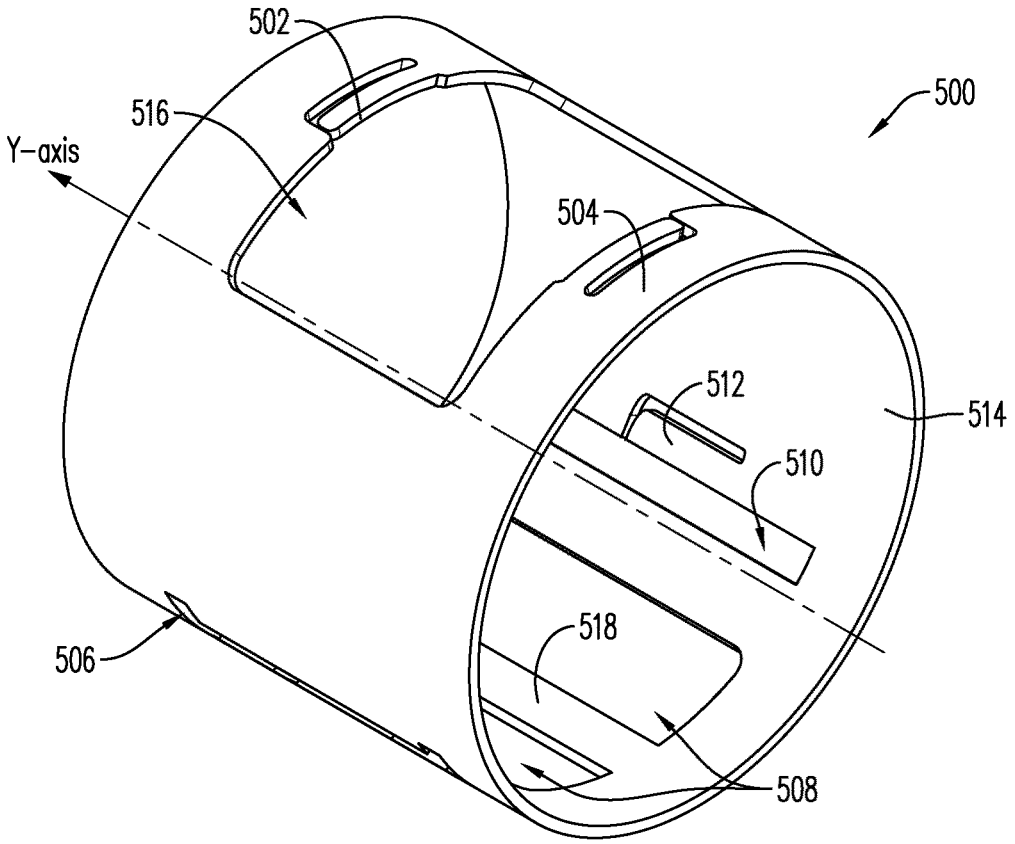
FIG. 5 illustrates a perspective view of a shaped charge carrier, in accordance with an embodiment.
Figure 6:
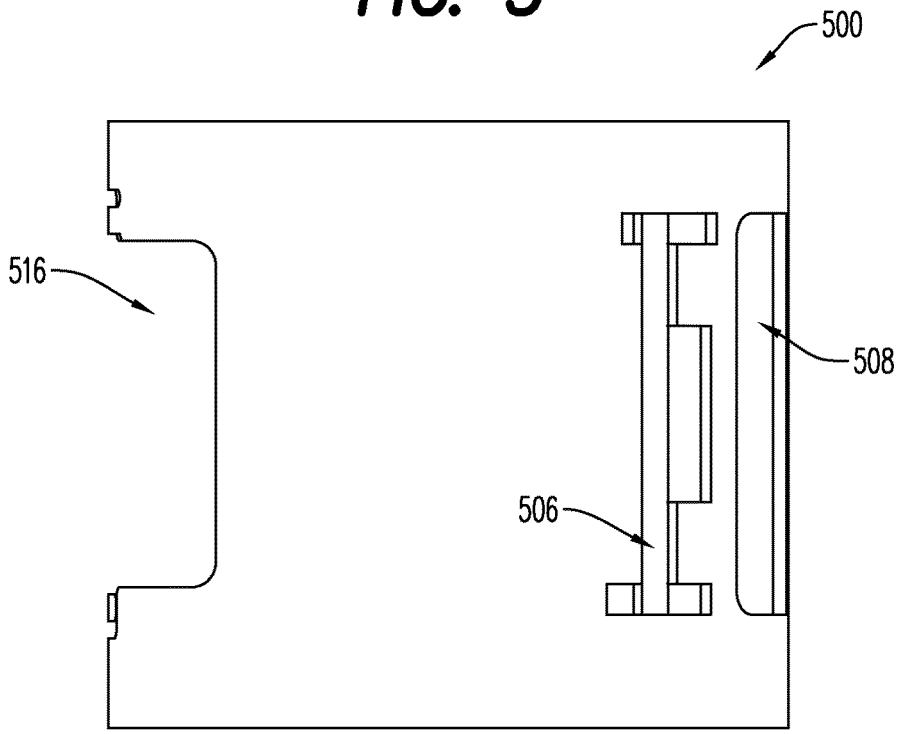
FIG. 6 illustrates a right-side view of a shaped charge carrier, in accordance with an embodiment.

According to an aspect and as illustrated in FIG. 5, the shaped charge carrier includes a window 508 which may help guide or position the inlay 100 into the shaped charge carrier 500. The window 508 is illustrated as an opening that would be positioned behind a shaped charge secured in the inlay 100. The window 508 can provide visibility of all components of the shaped charge carrier 500, such as, for example, a detonating cord 910 and the slotted charge, and helps a user confirm that such components have been correctly mounted or positioned correctly. FIG. 5 illustrates the window 508 separated into two windows, with a support wall 518 extending in the longitudinal direction (Y-axis) of the shaped charge carrier 500. The support wall 518 helps to provide structural support to the shaped charge carrier 500.

Wall receptacles 506 (FIG. 5 and FIG. 6) may be formed in the shaped charge carrier 500. The geometries of the wall receptacles 506 match and correspond with the geometries of the sidewall 106 of the inlay 100 (FIG. 4) so that the inlay 100 can be mounted and retained inside the wall receptacles 506 of the shaped charge carrier 500. For example, a side profile of the inlay 100 may include projections defined by the sidewalls 106, the detonating cord receptacle 122, and the detonating cord retainer 126, and the wall receptacle 506 may be formed with correspondingly dimensioned openings to receive the inlay profile projections and allow them to pass through the wall receptacle 506.

Figure 7:
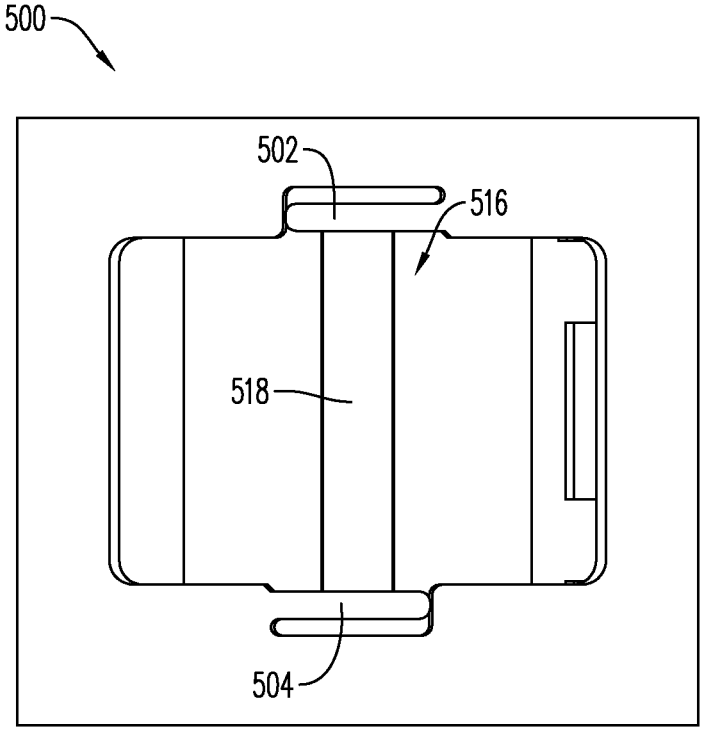
FIG. 7 illustrates a front view of a shaped charge carrier, in accordance with an embodiment.

FIG. 7 illustrates a front view of a shaped charge carrier 500. The shaped charge receptacle 516 is illustrated as a generally rectangular opening. It is contemplated, however, that the shaped charge receptacle 516 may have a different shape, depending on the shape of the shaped charge being secured therein. For example, if the shaped charge is a conical shaped charge, the shaped charge receptacle 516 may be configured as a generally circular opening.

The support wall 518 can be seen through a central portion of the shaped charge receptacle 516. When an inlay 100 is positioned in the shaped charge carrier 500, the inlay 100 and the corresponding shaped charge positioned in the inlay 100 can be supported, at least structurally, by the support wall 518.

Figure 8:
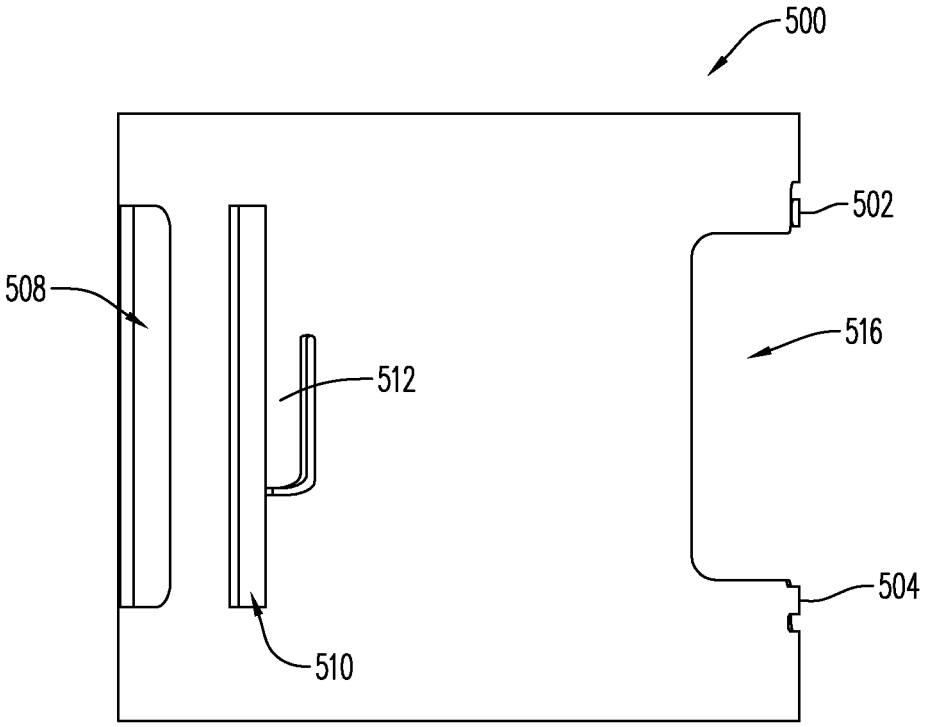
FIG. 8 illustrates a left-side view of a shaped charge carrier, in accordance with an embodiment.

FIG. 8 illustrates a portion of window 508, which is spaced apart from the shaped charge receptacle 516. In the embodiment of FIG. 8, the tab 502 and the tab 504, which flank the shaped charge receptacle 516, are illustrated as being spaced from each other so that they can physically couple different portions of a shaped charge positioned in the shaped charge receptacle 516.

Figure 9:
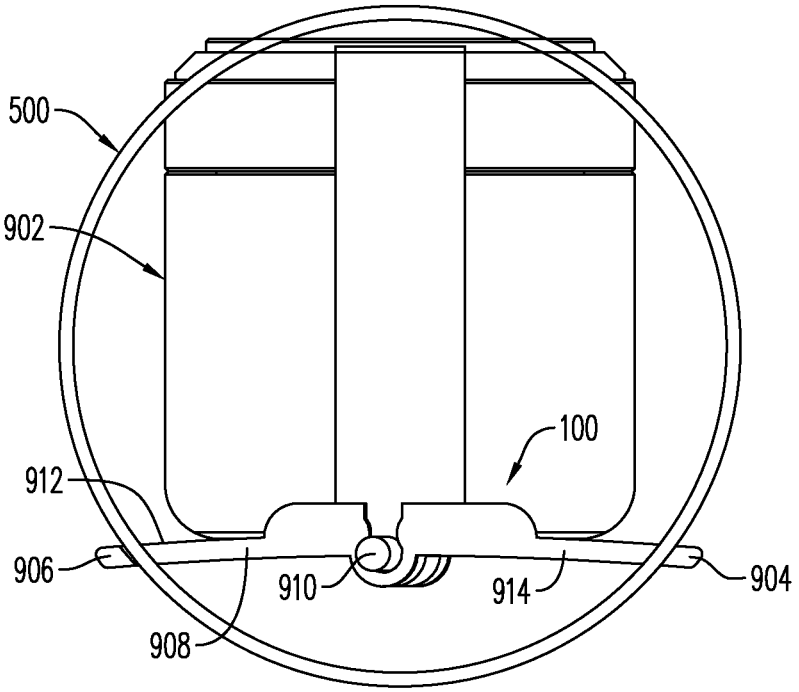
FIG. 9 illustrates a top, down view of a shaped charge carrier including an inlay, in accordance with an embodiment.
Figure 11:
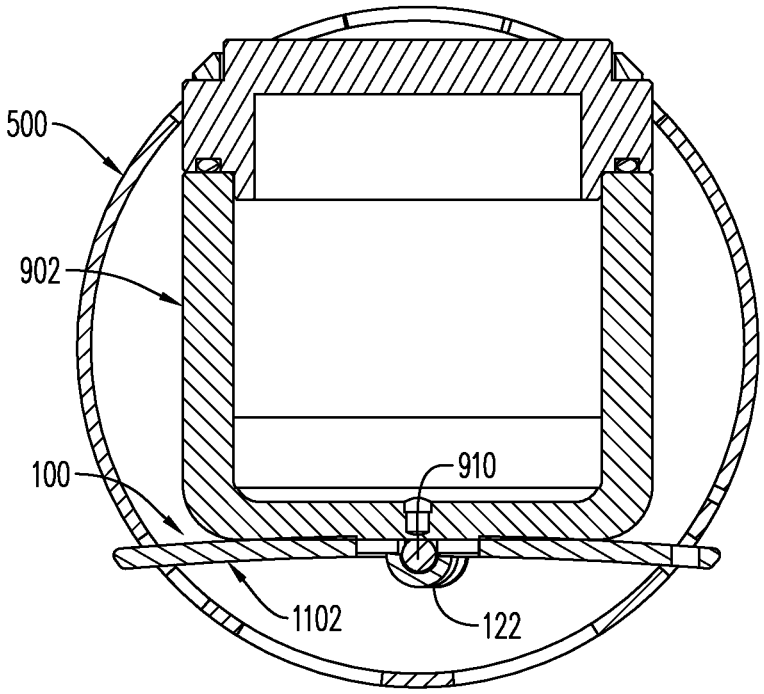
FIG. 11 illustrates a partial, cross-sectional view of a shaped charge carrier including an inlay, in accordance with an embodiment.
Figure 12:
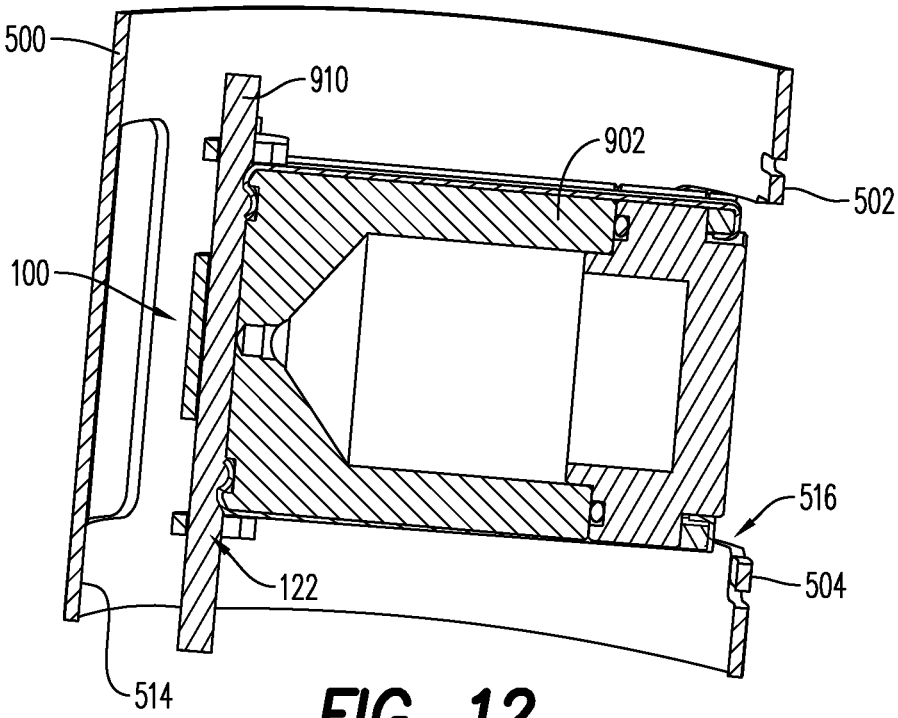
FIG. 12 illustrates a partial, cross-sectional view of a shaped charge carrier including an inlay, in accordance with an embodiment.

FIG. 9, FIG. 11-12 illustrate the inlay 100, as shown in FIGS. 1-4, being used in conjunction with the shaped charge carrier 500. In an exemplary insertion process (not shown), the first wing portion 102 may be inserted into the wall receptacle 506, and the sidewalls 106, detonating cord receptacle 122, detonating cord retainer 126, and second wing portion 104 may be passed through the wall receptacle 506. When the inlay 100 is fully inserted into the shaped charge carrier 500, an outer edge 904 of the first wing portion 102 can be passed through the inlay retention slot 510. The tab 512 adjacent the inlay retention slot 510 may be bent towards the inlay retention slot 510 in order to help secure the inlay 100 within the shaped charge carrier 500. This can help to create a closed interior wall of the shaped charge carrier 500 onto which a slotted shaped charge can be secured and oriented in a desired radial position.

The first end 116 and the second end 118 of the limit stop 114 of the inlay 100 may be sized to extend outwardly from the second wing portion 104 and beyond the bounds of the wall receptacle 506 of the shaped charge carrier 500. It is contemplated that this will help to prevent the inlay 100 from passing completely through the wall receptacle 506, and thus help to retain the shaped charge 902 in the shaped charge carrier 500.

According to an aspect, the sidewalls 106 of the inlay 100 may be spaced apart such that they help to fix the slotted shaped charge 902 in an axial direction in the inlay 100, and therefore the charge carrier 500. The slotted shaped charge 902 may be inserted through the shaped charge receptacle 516 such that the opening of the slotted shaped charge is facing the receptacle 516 and the detonating cord 910 is configured for ballistic contact with a bottom of the shaped charge 902 for initiation of the shaped charge 902. The tabs formed in the wall surfaces of the shaped charge receptacle 516 may be bent and then repositioned to secure the slotted shaped charge 902 within the charge carrier 500.

Figure 10:
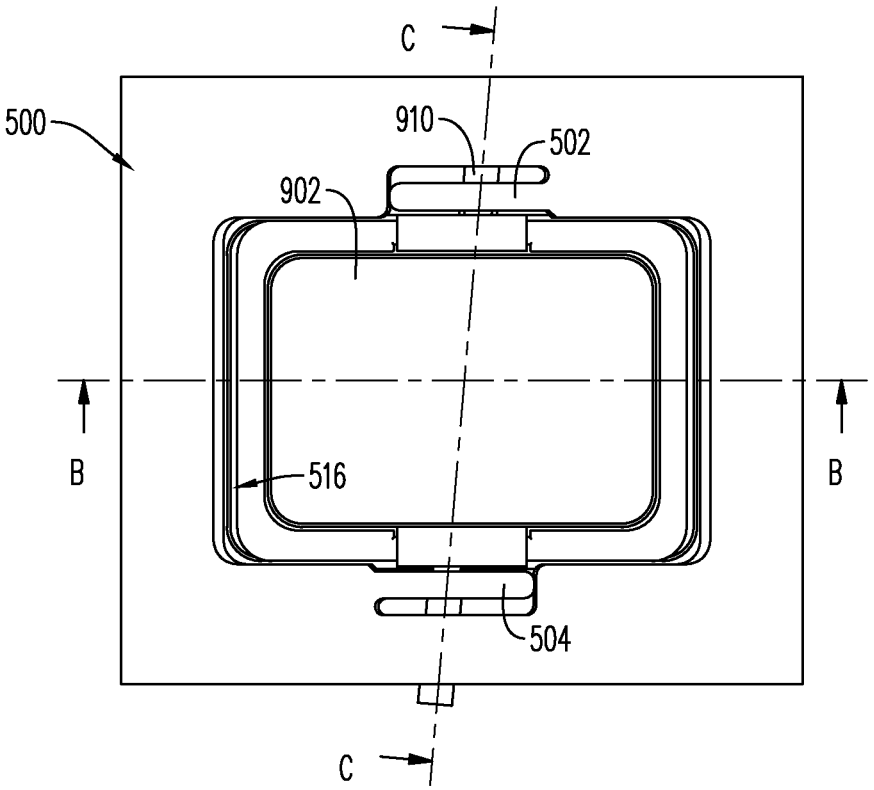
FIG. 10 illustrates a front view of a shaped charge carrier including an inlay, in accordance with an embodiment.

FIG. 10 illustrates a front view of a portion of a shaped charge carrier 500, within which a slotted shaped charge 902 and an inlay (not shown) is positioned. The tab 502 and tab 504 are illustrated in their non-deformed configuration, however, the tab 502 and tab 504 may be bent towards the shaped charge 902 so that they help to retain the shaped charge 902 within the shaped charge receptacle 516, and thus, the shaped charge carrier 500.

FIG. 11 illustrates the shaped charge 902 positioned in the inlay 100, and the inlay 100 secured within the shaped charge carrier 500. A detonating cord 910 is secured in the detonating cord receptacle 122 and may be adjacent an initiation point of the shaped charge 902.

FIG. 12 illustrates the detonating cord 910 traversing the detonating cord receptacle 122. As illustrated, the detonating cord 910 is adjacent a back wall of the shaped charge 902, so that it can initiate the shaped charge 902 positioned in the shaped charge carrier 500. While not shown in this Figure, the detonating cord 910 may be secured to the inlay 100 by virtue of being positioned below the recesses 120.

Figure 13:
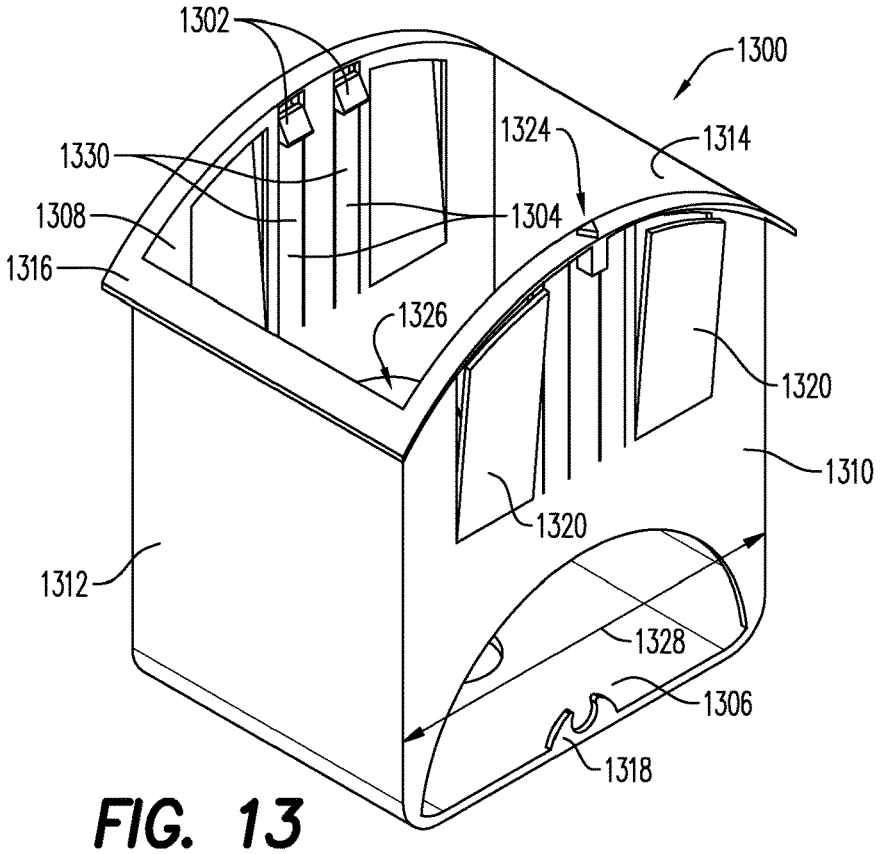
FIG. 13 illustrates a perspective view of a jacket, in accordance with an embodiment.

Additional exemplary embodiments of the disclosure are associated with a jacket 1300 for use with a shaped charge. FIG. 13 may be configured as a generally rectangular or square structure having a plurality of walls and an open front portion through which a slotted shaped charge 902 may be positioned.

As illustrated in FIG. 13, for example, the jacket 1300 includes a back wall 1306, a top wall 1308, a bottom wall 1310 spaced apart from the top wall 1308, and a pair of side walls (first sidewall 1312 and second side wall 1314) spaced apart and extending between the top wall 1308 and the bottom wall 1310. The back wall 1306 may be connected to each of the first sidewall 1312, the second side wall 1314, the top wall 1308 and the bottom wall 1310. The jacket 1300 includes an internal cavity 1326 or hollow interior, which is bounded by the first sidewall 1312, the second side wall 1314, the top wall 1308 and the bottom wall 1310, and accessible through an open front portion 1322 of the jacket 1300.

The top wall 1308 and the bottom wall 1310 are each illustrated as including a housing retention mechanism 1320 that extends outward in a direction away from the back wall 1306 and the internal cavity 1326. The housing retention mechanism 1320 may be biased outwardly to engage a portion of a shaped charge carrier 1700 to secure the jacket 1300 within the shaped charge carrier 1700. For example, the housing retention mechanism 1320 may engage with a portion of the wall 1702 of the shaped charge carrier 1700 adjacent to the shaped charge receptacle 1706.

Figure 14:
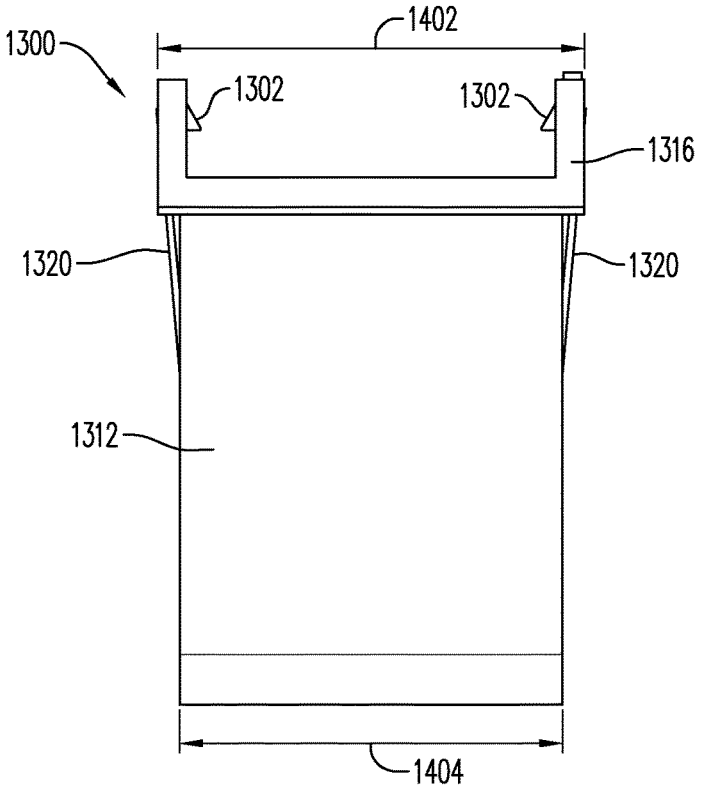
FIG. 14 illustrates a left-side view of a jacket, in accordance with an embodiment.

According to an aspect, the top wall 1308 and the bottom wall 1310 may include a retention latch 1304 that project inwardly towards the internal cavity 1326 of the jacket 1300. The retention latch 1304 may help engage the wall of a shaped charge 902 and retain the shaped charge 902 within the internal cavity 1326 of the jacket 1300. The retention latch 1304 may include a protrusion 1302 that extends in a direction that overlaps the internal cavity 1326 of the jacket 1300. As shown in FIG. 13, a plurality of retention latches 1304 may be provided on the same side or on opposite sides (FIG. 14 of the jacket 1300). For example and as illustrated in FIG. 13, two retention latches 1304 may be provided on the top wall 1308. As illustrated in FIG. 14, a pair of retention latches 1304 (e.g. with protrusion 1302 visible in FIG. 14) may be provided on the jacket 1300, with a first retention latch 1304 being positioned in a spaced apart configuration from a second retention latch 1304. The protrusion 1302 of each retention latch 1304, as shown, may overlap the internal cavity 1326 of the jacket 1300 to retain the shaped charge 902 within the internal cavity 1326 of the jacket 1300.

According to an aspect, the housing retention mechanism 1320 and the retention latch 1304 are flexible cut out portions of the top wall 1308 and the bottom wall 1310. While only the retention latch 1304 is shown including an arm 1330 and a protrusion 1302 extending from the arm, it is contemplated that the housing retention mechanism 1320 may also include also include a protrusion or a surface feature to help secure the jacket 1300 to the shaped charge carrier 1700 in some embodiments. The shaped charge retention latch 1304 and the housing retention mechanism 1320 may generally have any geometry or locking configuration consistent with this disclosure.

According to an aspect, the jacket 1300 may further include a collar 1316 at the open front portion 1322. The collar 1316 may be spaced apart from the back wall 1306 and may extend from or be otherwise connected to each of the first sidewall 1312, the second side wall 1314, the top wall 1308 and the bottom wall 1310. The collar 1316 may extend outwardly from the first sidewall 1312, the second side wall 1314, the top wall 1308 and the bottom wall 1310 in each of the axial and the radial direction of the jacket 1300.

According to an aspect, the collar 1316 can include a key 1324 configured to help adjust a phasing of the jacket 1300, and therefore the shaped charge 902 positioned in the jacket 1300, in the shaped charge carrier 1700. In some embodiments, the key 1324 extends upwardly from and in a direction perpendicular to the collar 1316. The key 1324 may be configured to be received within one of a plurality of orientation slots 1704 formed in a shaped charge carrier 1700. In combination with the shaped charge carrier 1700, the jacket 1300 may help to facilitate an individual "meander" design or orientation of the shaped charges 902 in the shaped charge carrier 1700.

According to an aspect, various features of the jacket 1300 may be dimensioned according to the needs of the application. For example, the collar 1316 of the jacket 1300 may be sized or otherwise dimensioned so that it does not pass through a wall 1702 of a shaped charge carrier 1700 (FIG. 17), while the first sidewall 1312 or second side wall 1314 may be sized so that they pass through the wall 1702 and are positioned within the shaped charge receptacle 1706 of the shaped charge carrier 1700. The first sidewall 1312 or second side wall 1314 may include a first outer diameter 1404, while the collar 1316 may include a third outer diameter 1402. According to an aspect, the third outer diameter 1402 is greater than the first outer diameter 1404.

Figure 15:
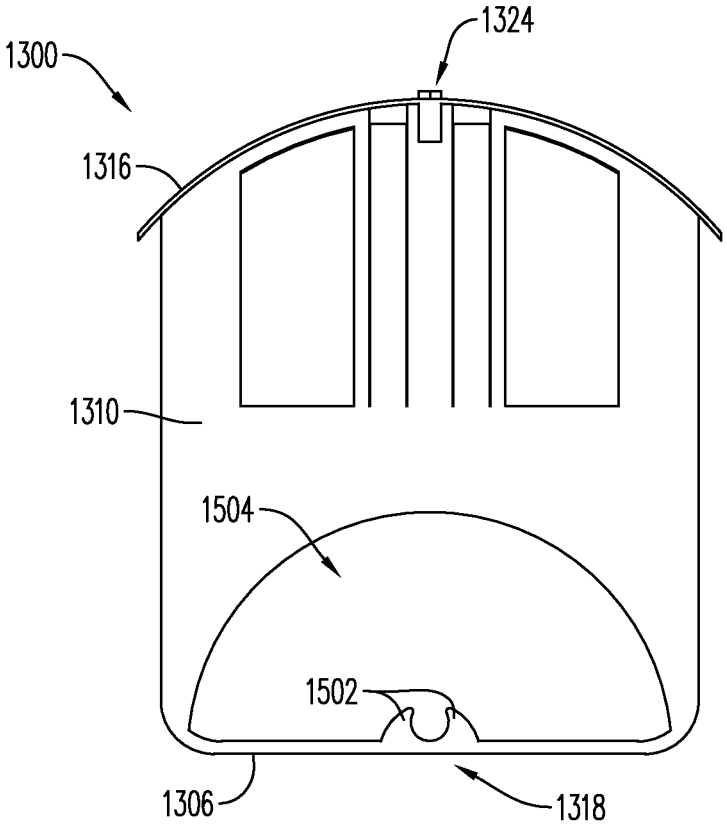
FIG. 15 illustrates a top view of a jacket, in accordance with an embodiment.

FIG. 15 illustrates a detonating cord receptacle 1318 in more detail. In some embodiments, the detonating cord receptacle 1318 includes a pair of opposed arms 1502, with each arm 1502 of the pair of opposed arms 1502 extending toward each other. The opposed arms 1502 define a channel therebetween, within which a detonating cord 910 may be positioned. The arms 1502 may project from the back wall 1306 and extend in a direction toward the internal cavity 1326 of the jacket 1300.

Figure 16:
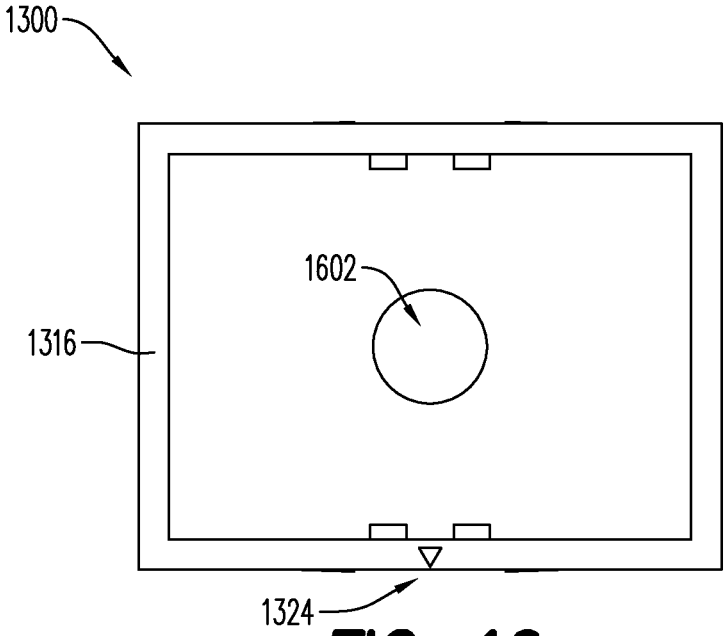
FIG. 16 illustrates a front view of a jacket, in accordance with an embodiment

With reference to FIG. 15 and FIG. 16, one or more windows 1504 may be provided in a wall of the jacket 1300 to provide visibility of the components, such as the shaped charge 902 and detonating cord 910 positioned in the jacket 1300, as discussed in further detail below.

As seen, for example, in FIG. 16, the jacket 1300 may include a window 1602 formed in the back wall 1306. While the window 1602 is illustrated as a circular opening, it is contemplated that the window 1602 may be configured in any desired shape. The window 1602 may be centrally located in the back wall 1306. According to an aspect, the window 1602 may be eccentric from the first sidewall 1312, the second side wall 1314, the top wall 1308 and the bottom wall 1310.

It is contemplated that the jacket 1300 may be composed of plastic or steel, as described hereinabove with respect to the inlay 100. The jacket 1300 may be injection molded or 3D printed. It is also contemplated that the jacket 1300 may be a unitary structure. Alternatively, the jacket 1300 may be formed from a plurality of components that are secured together. For example, each of the top wall 1308, the bottom wall 1310, the first sidewall 1312, the second side wall 1314 and the back wall 1306 may be separate pieces that are secured together by a fastening mechanism. It is contemplated that the jacket 1300 may be fixed in position by one or more of, e.g., the shaped charge carrier 1700, the shaped charge 902, a fixation band and/or a corresponding jacket 1300 component.

Figure 17:
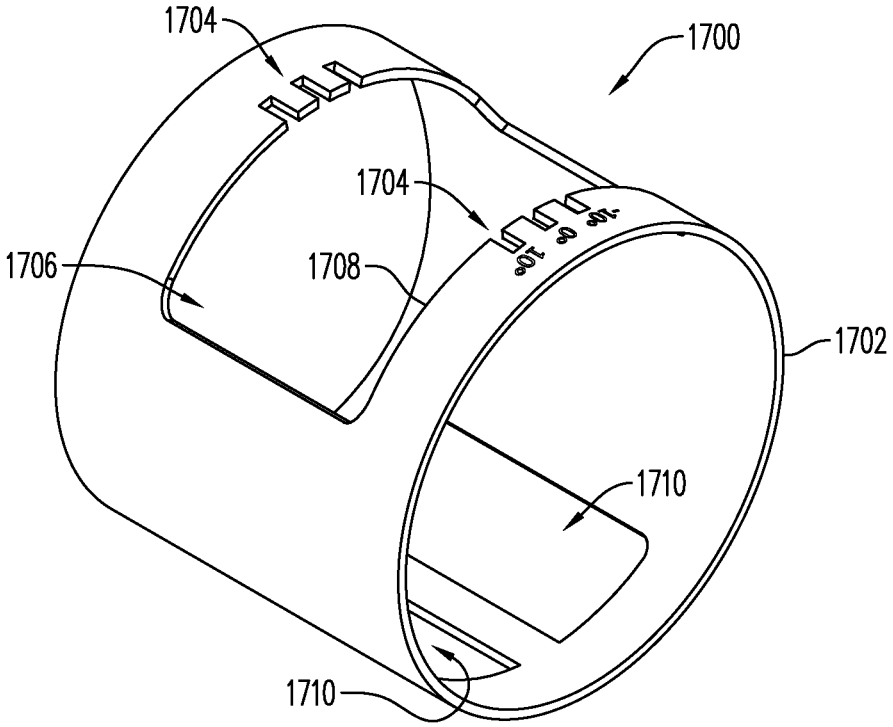
FIG. 17 illustrates a perspective view of a shaped charge carrier, in accordance with an embodiment.
Figure 18:
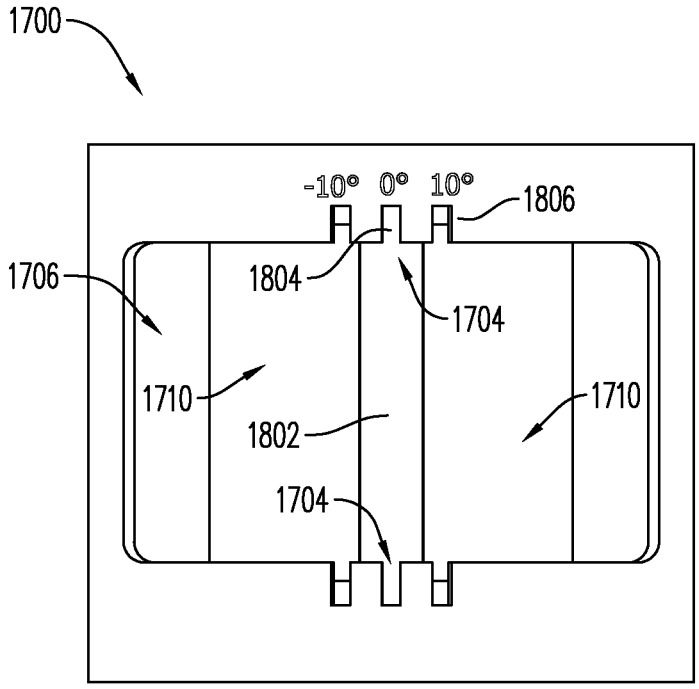
FIG. 18 illustrates a front view of a shaped charge carrier, in accordance with an embodiment.

FIG. 17 and FIG. 18 illustrate an exemplary shaped charge carrier 1700, within which the jacket 1300 may be positioned. The shaped charge carrier 1700 may be formed from steel. According to an aspect, the shaped charge carrier 1700 has an elongation value below about 15%. As understood by one of ordinary skill in the art, the elongation value equates to how ductile the shaped charge carrier 1700 will be. The shaped charge carrier 1700 contemplated herein, may have a modulus of elasticity of about 200 GPa. The ductility value and the elasticity values of the steel used to make the shaped charge carrier 1700 can provide a shaped charge carrier 1700 that will be able to withstand the weight of the shaped charges 902, and corresponding perforating gun components housed by the shaped charge carrier 1700.

The shaped charge carrier 1700 includes a wall 1702 and a shaped charge receptacle 1706 formed in the wall 1702. The shaped charge receptacle 1706 may be configured as an opening that extends through the wall 1702. While the shaped charge receptacle 1706 is illustrated as a rectangular opening, the shaped charge receptacle 1706 may be configured as any other shape, depending at least in part on the shape of the shaped charge 902 that will be secured therein.

The shaped charge carrier 1700 may include a window 1710 to help position the jacket 1300 into the shaped charge carrier 1700. The window 1710 is illustrated as an opening that would be positioned behind the back wall 1306 of the jacket 1300 containing the shaped charge 902. The window 1710 provides visibility of all components of the shaped charge carrier 1700, such as, for example, the detonating cord 910 and the shaped charge 902, and may help a user confirm that such components have been correctly mounted or positioned correctly.

FIG. 18 illustrate the window 1710 separated into two windows 1710, with a band 1802 (support wall) extending in the longitudinal direction (Y-axis) of the shaped charge carrier 1700. The band 1802 may be a piece of the shaped charge carrier 1700 that bifurcates the window 1710. According to an aspect, the band 1802 can support the weight of the jacket 1300 and the shaped charge 902 secured in the jacket 1300

A plurality of keyholes or orientation slots 1704 may be formed on at least one surface of the wall 1702 that surround the shaped charge receptacle 1706. The orientation slot 1704 can be configured to receive the key 1324 formed on the collar 1316 of the jacket 1300. According to an aspect, three or more opposing, rectangular pairs of orientation slots 1704 are formed on two surfaces, along the longitudinal direction/Y-axis of the shaped charge carrier 1700, of opposing walls 1702 surrounding the shaped charge receptacle 1706. Each pair of the three or more pairs of orientation slots 1704 can orient the inlay housing in a predefined phasing or orientation. This allows a selectable orientation of the jacket 1300, and therefore the shaped charge 902 secured in the jacket 1300. Each orientation slot 1704 may be labeled with the corresponding degree phasing of each orientation slot 1704 for selectable orientation by the user. For example, a first orientation slot 1804 of the plurality of orientation slots 1704 can define a phasing of 0 degrees. The first orientation slot 1804 may be labeled 0°. A second orientation slot 1806 of the orientation slots 1704 may define a phasing of greater than or less than 10 degrees, and may be labeled with the degree of phasing. For example, the second orientation slot 1806 may be labeled 10° or −10°.

Figure 19:
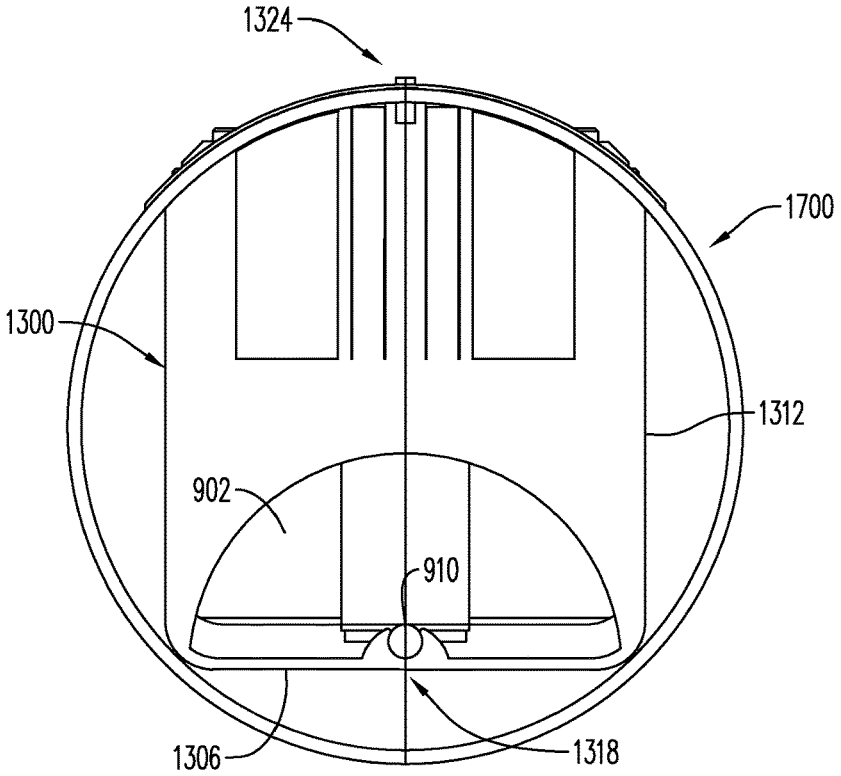
FIG. 19 illustrates a top, down view of a shaped charge carrier including a jacket phased at an angle of 0°, in accordance with an embodiment.

FIG. 19 illustrates the jacket 1300 positioned in the shaped charge carrier 1700. The shaped charge 902 can be seen through the window 1602 formed in the jacket 1300. As described hereinabove, windows provided in the top wall 1308 or the bottom wall 1310 of the jacket 1300, or within back wall 1306 can allow a user to visualize the position of the shaped charge 902 and/or the detonating cord 910 positioned in the jacket 1300 so that any necessary adjustments can be made.

The jacket 1300 may be installed into the shaped charge carrier 1700 via the shaped charge receptacle 1706 formed in the wall 1702 of the shaped charge carrier 1700. The collar 1316 and the housing retention mechanism 1320 may help to retain the jacket 1300 within the shaped charge receptacle 1706. It is also contemplated that axial movement of the jacket 1300 within the shaped charge carrier 1700 may be further limited by securing at least a portion of the jacket 1300 within an opening or window of the shaped charge carrier 1700. FIG. 19 illustrates a slotted shaped charge secured within the internal cavity 1326 of the jacket 1300. The slotted shaped charge may be secured in position by virtue of being retained by the retention latches 1304.

The one or more windows may also allow guidance of the detonating cord 910 through the shaped charge carrier 1700. The detonating cord 910 may be positioned in the jacket 1300 by being positioned or pressed into position through the largest slot, window or opening in the shaped charge carrier 1700 before the shaped charge 902 is placed into position.

Figure 20:
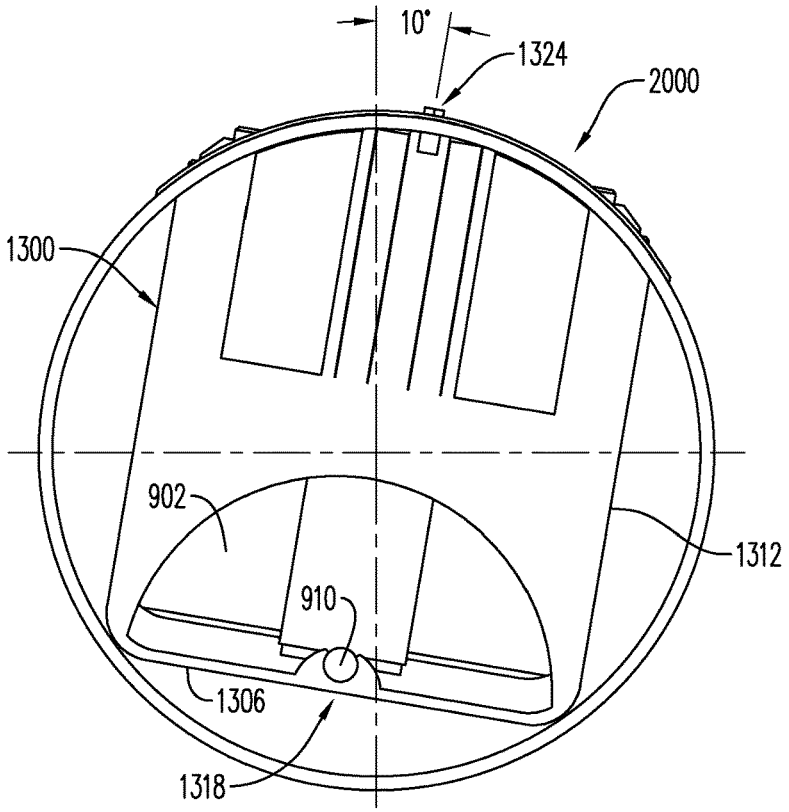
FIG. 20 illustrates a top, down view of a shaped charge carrier including a jacket phased at an angle of 10°, in accordance with an embodiment.

FIG. 19 illustrates the key 1324 being positioned in the first orientation slot 1804 of the plurality of orientation slots 1704 (e.g. as shown in FIG. 18), thereby defining a phasing of 0 degrees. FIG. 20 illustrates the key 1324 being positioned in the second orientation slot 1806 of the plurality of orientation slots 1704 (e.g. as shown in FIG. 18), thereby defining a phasing of 10 degrees. As can be seen in FIG. 20, the jacket 1300 and corresponding shaped charge 902 is slightly tilted, as compared to the configuration illustrated in FIG. 19.

Figure 21:
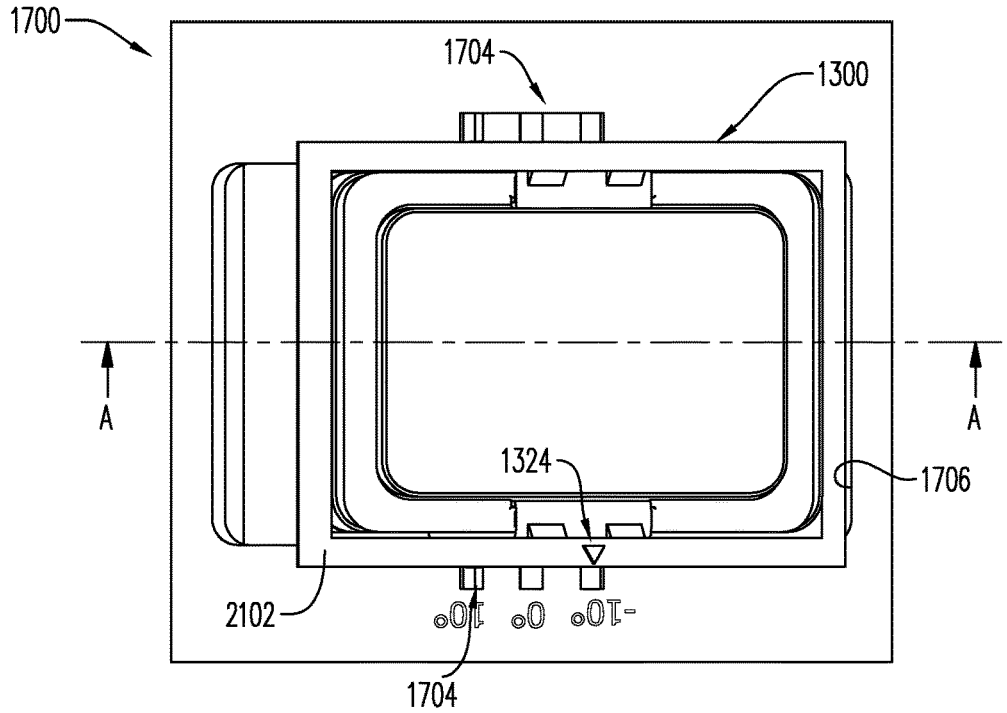
FIG. 21 illustrates a front view of a shaped charge carrier including a jacket phased at an angle of 10°, in accordance with an embodiment.
Figure 22:
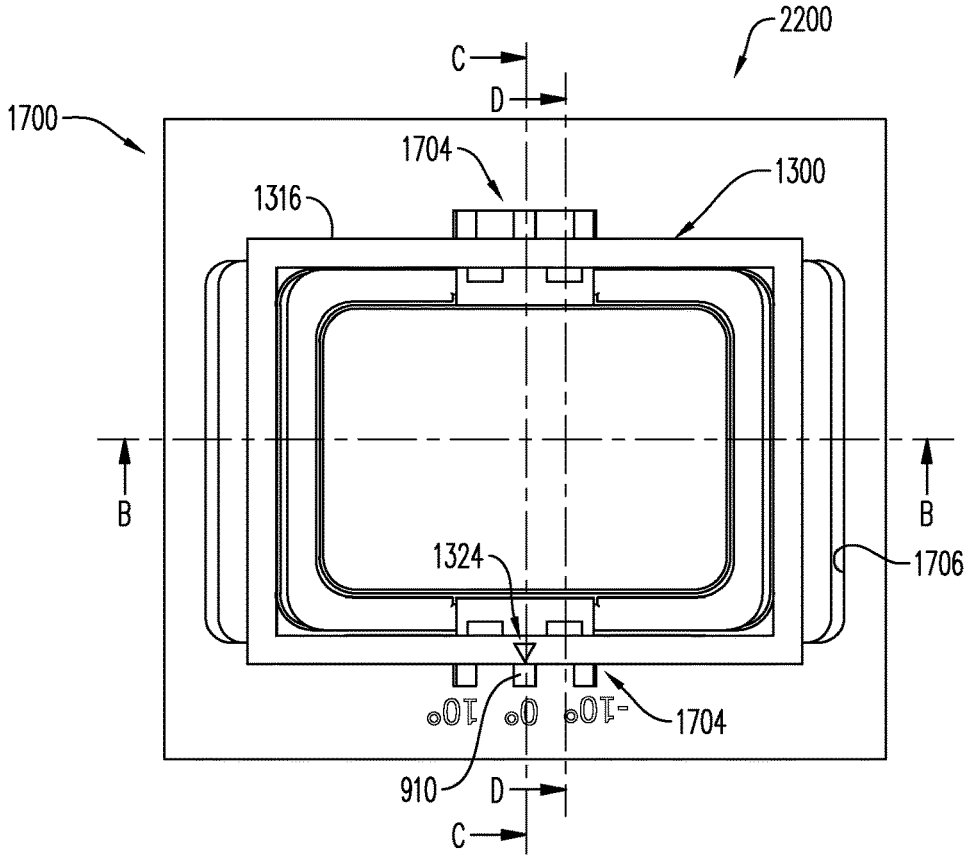
FIG. 22 illustrates a front view of a shaped charge carrier including a jacket phased at an angle of 10°, in accordance with an embodiment.

FIGS. 21-23 and FIGS. 24-26 illustrate different orientations of the inlay housing. Each of FIG. 21 and FIG. 22 is a front view of the jacket 1300, within which the shaped charge 902 is positioned, housed in the shaped charge carrier 1700. FIG. 21 illustrates the shaped charge 902 at 0 degree phasing.

FIG. 22 illustrates the jacket 1300 and corresponding shaped charge 902 at 10 degree phasing. In both FIG. 21 and FIG. 22, it is clearly seen that the collar 1316 extends around at least a portion of the periphery of the shaped charge receptacle 1706. The collar 1316 prevents over-insertion of the jacket 1300 within the shaped charge receptacle 1706, but also helps to provide a surface for placement of the key 1324 so that the key can be readily identified during the process of assembling the shaped charge carrier 1700.

Figure 23:
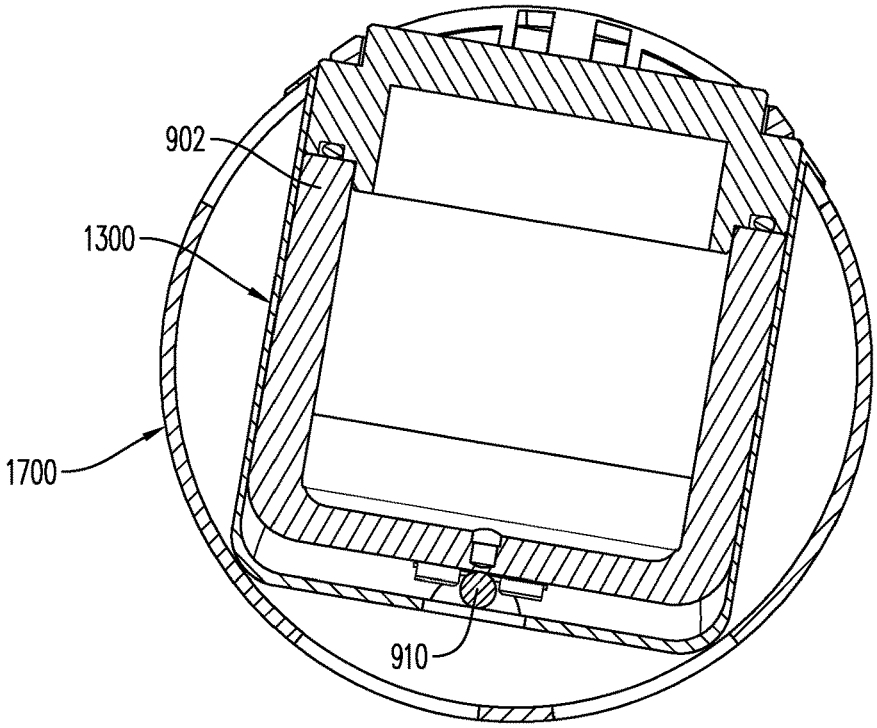
FIG. 23 illustrates a cross-sectional view a shaped charge carrier including a jacket phased at an angle of 10°, in accordance with an embodiment.

FIG. 23 illustrates the jacket 1300 and corresponding shaped charge 902 at 10 degree phasing.

Figure 24:
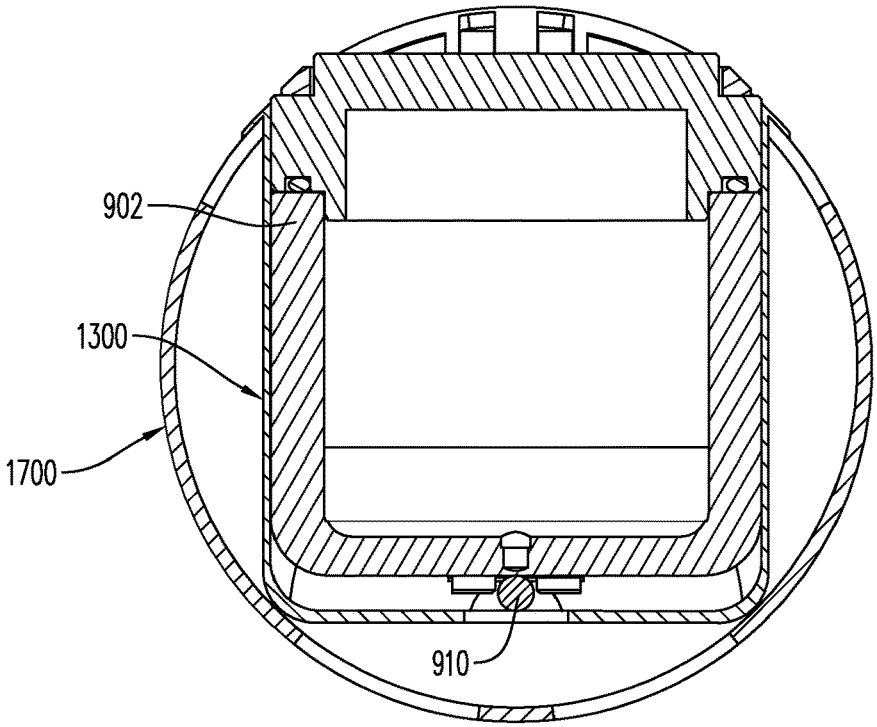
FIG. 24 illustrates a cross-sectional view a shaped charge carrier including a jacket phased at an angle of 0°, in accordance with an embodiment.

FIG. 24 illustrates the jacket 1300 and corresponding shaped charge 902 at 0 degree phasing.

Figure 25:
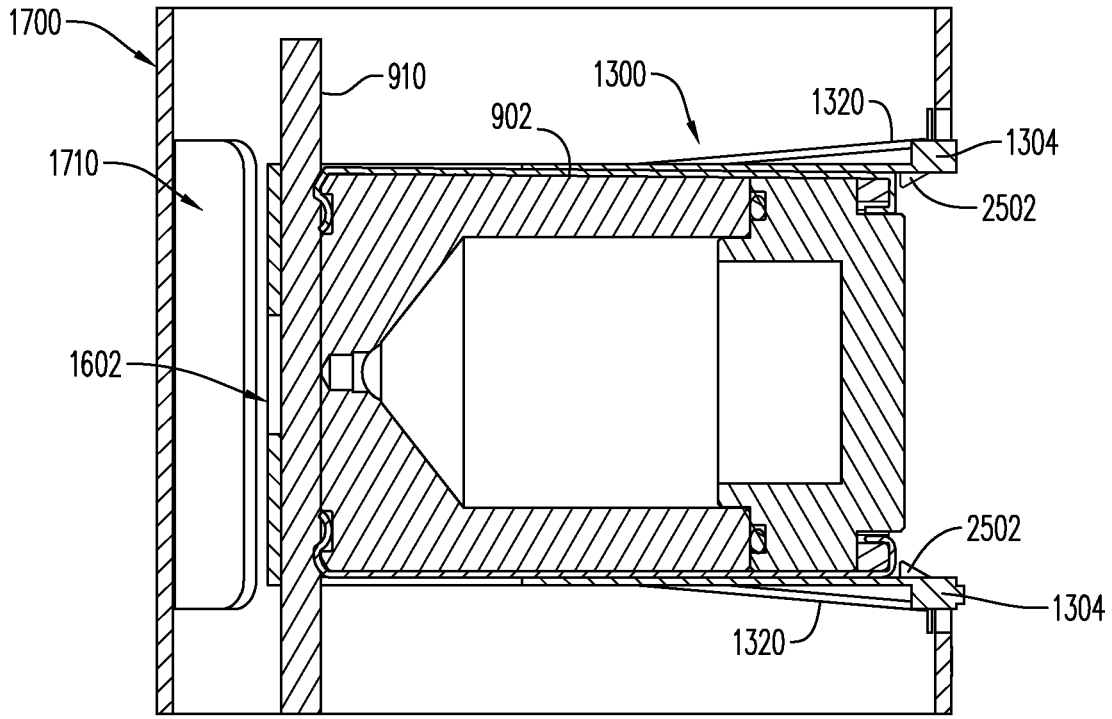
FIG. 25 is a cross-sectional view a shaped charge carrier including a jacket housing a shaped charge and a detonating cord connected to the shaped charge, in accordance with an embodiment.

FIG. 25 shows the detonating cord 910 positioned adjacent the back wall 1306 of the jacket 1300, within the internal cavity 1326, and adjacent the shaped charge 902. The window 1602 is adjacent the detonating cord 910 and can be used to verify the position of the detonating cord 910 cord in the shaped charge carrier 1700. The retention latch 1304 is illustrated as being in engagement with the shaped charge 902 positioned in the jacket 1300.

Figure 26:
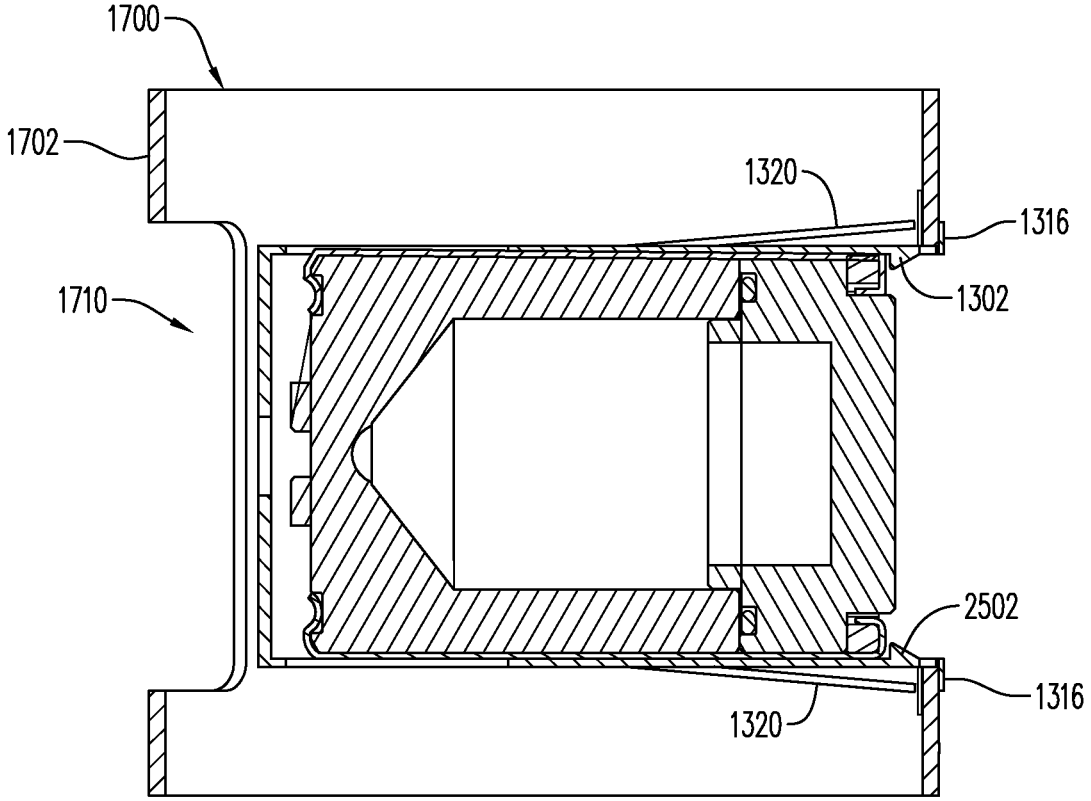
FIG. 26 is a cross-sectional view a shaped charge carrier including a jacket housing a shaped charge, in accordance with an embodiment.

FIG. 26 illustrates the collar 1316 engaging an outer surface of the shaped charge carrier 1700, and protrusions 2502 engaging the shaped charge 902 positioned in the jacket 1300.

Figure 27:
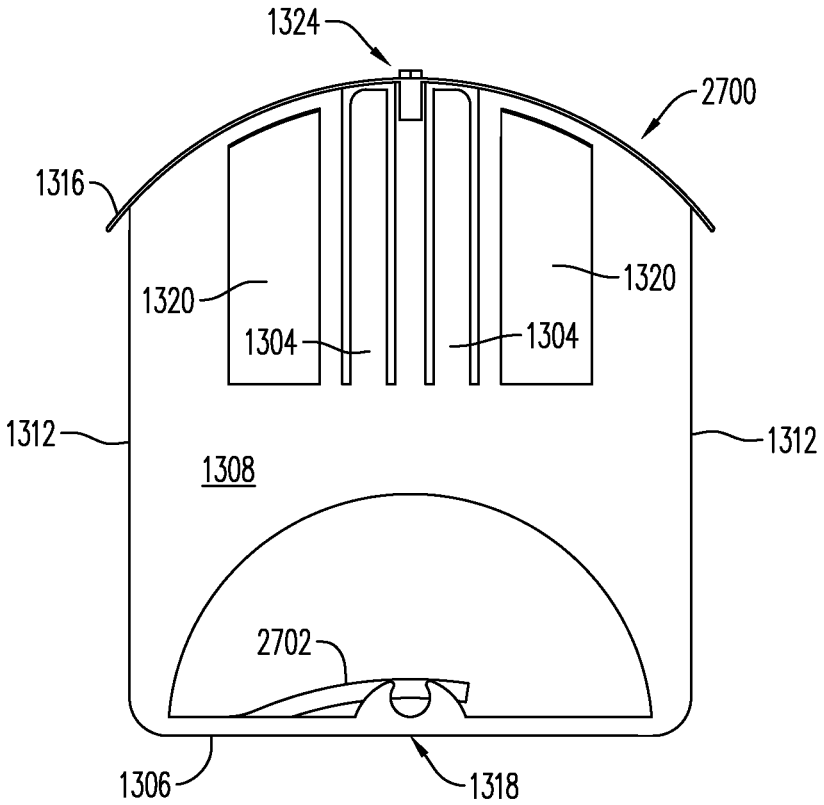
FIG. 27 illustrates a top view of a jacket, in accordance with an embodiment.

FIG. 27 is an alternate embodiment of a jacket 2700. The jacket 2700 may be configured substantially as the jacket 1300 described hereinabove, thus for purpose of convenience and not limitation, the various features of the jacket 1300 that are also a part of the jacket 2700 are not repeated hereinbelow. In the embodiment of FIG. 27, a detonating cord receptacle 1318 extends from the back wall 1306 and into the internal cavity 1326. The detonating cord receptacle 1318 can receive and help to guide a detonating cord 910 in the shaped charge carrier.

Figure 28:
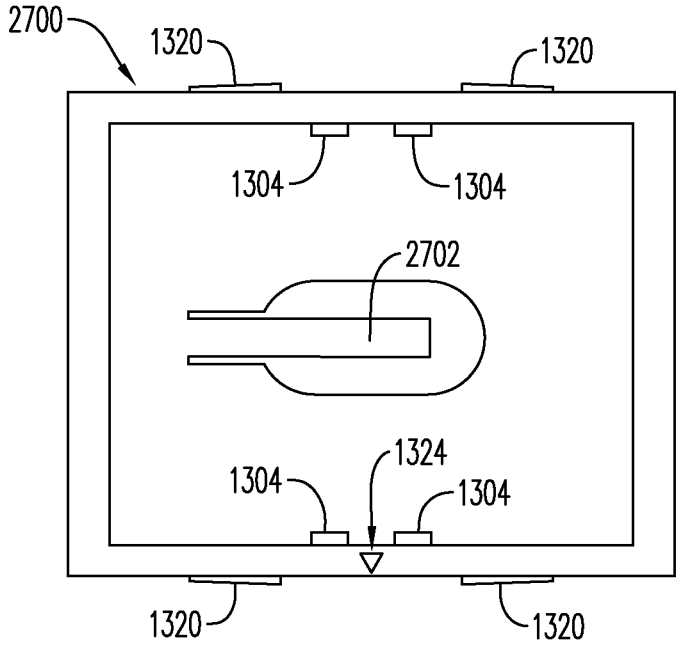
FIG. 28 illustrates a front view of the jacket of FIG. 27.

As illustrated in FIG. 27 and FIG. 28, a clasp or a clip 2702 may be positioned in a covering relationship with the detonating cord receptacle 1318. The clip 2702 may extend from an internal surface of the back wall 1306. The clip 2702 may have an attached end and a biased free end spaced apart from the attached end. According to an aspect, the clip 2702 may be formed by stamping out a portion of the back wall 1306 of the jacket 2700. It is contemplated that the clip 2702 may be an injection molded portion of the jacket 2700. The clip 2702 may help to frictionally retain the detonating cord 910 in the detonating cord receptacle 1318 and adjacent an initiation point of the shaped charge 902 housed in the jacket 2700, helping to reduce the risk of creating a water gap between the detonating cord 910 and shaped charge 902 and hence the risk for a miss-initiation of the shaped charge 902.

Figure 29:
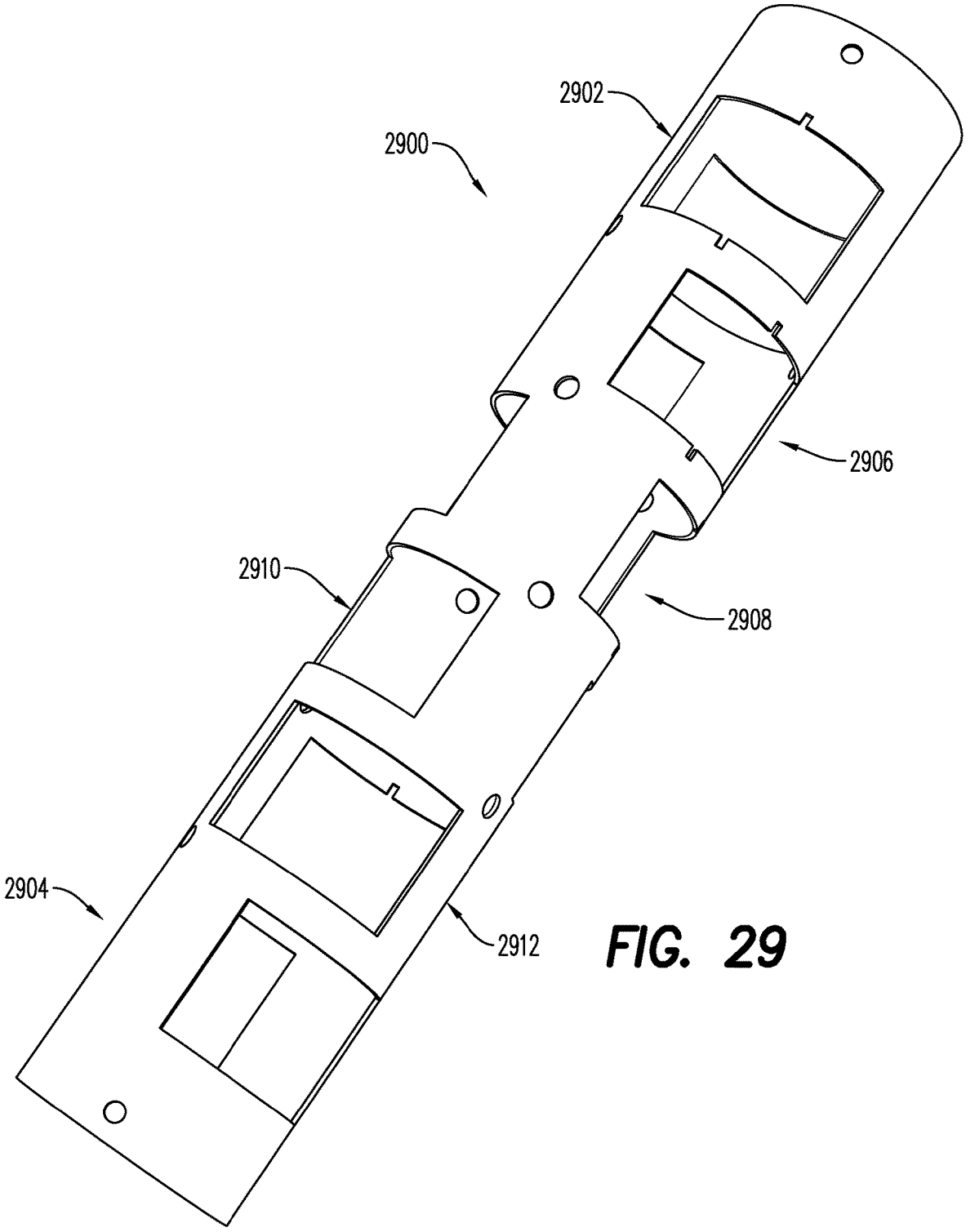
FIG. 29 illustrates a perspective view of a shaped charge carrier having a plurality of shaped charge receptacles, in accordance with an embodiment.

FIG. 29 illustrates an exemplary shaped charge carrier 2900 configured as a generally cylindrical structure. The shaped charge carrier 2900 may be configured with a plurality of shaped charge receptacles, openings and slots that extend through a wall of the shaped charge carrier 2900. The shaped charge receptacles may be configured as a square or a rectangular opening with four wall surfaces. The shaped charge receptacles may each be an opening that extends through the wall. FIG. 29 illustrates shaped charge receptacle 2902, shaped charge receptacle 2904, shaped charge receptacle 2906, shaped charge receptacle 2908, shaped charge receptacle 2910 and shaped charge receptacle 2912, however it is contemplated that more of less shaped charge receptacles may be provided.

Figure 30:
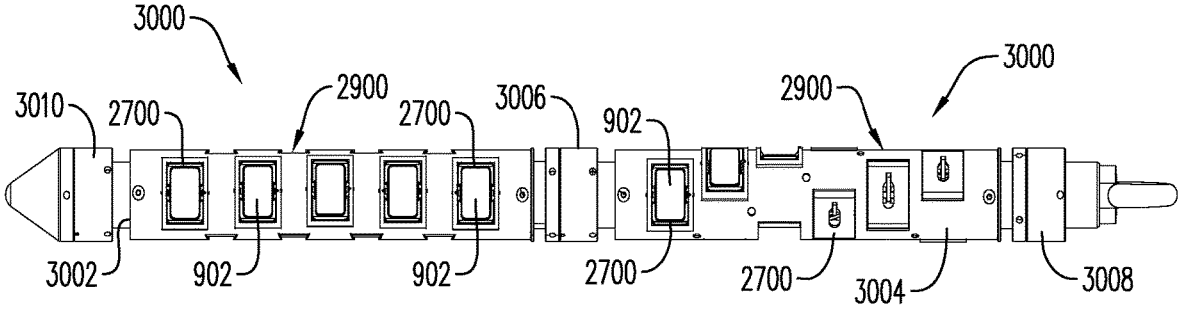
FIG. 30 illustrates a side view of a tool string including a connector between adjacent shaped charge carriers, in accordance with an embodiment.
Figure 31:
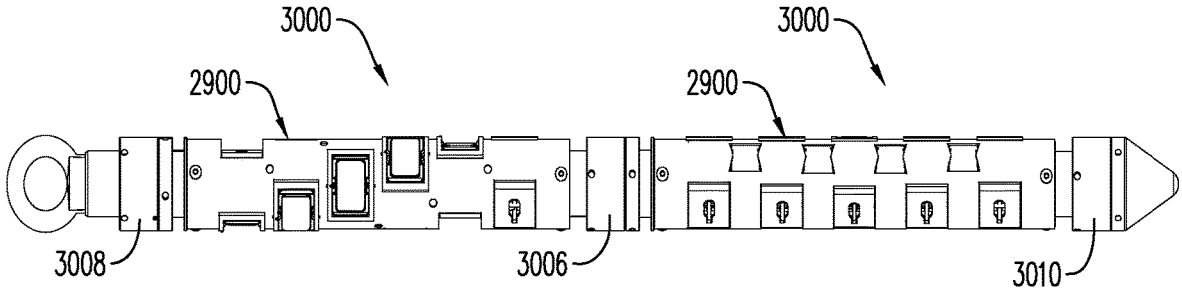
FIG. 31 illustrates a side view of a tool string including a connector between adjacent shaped charge carriers, in accordance with an embodiment.

FIG. 30 and FIG. 31 illustrate an exemplary perforating gun assembly 3000 including a plurality of shaped charge carriers 2900. A first shaped charge carrier 3002 is depicted including a plurality of shaped charges 902 positioned in a meander design along the longitudinal axis of the carrier. A second shaped charge carrier 3004 is depicted including shaped charges positioned in a spiral configuration along the length of the shaped charge carrier 2900. Ion some embodiment, one or more of the shaped charges 902 may be positioned in line, or along the same direction along a length of the shaped charge carrier 2900.

The first shaped charge carrier 3002 and the second shaped charge carrier 3004 may be connected to each other by a connector 3006. According to an aspect, the perforating gun assembly 3000 can include a nose portion 3010 that guides the perforating gun assembly 3000 through restrictions of the wellbore, and a tail portion 3008 that may be used to move the perforating gun assembly 3000 from a first location to a second location. According to an aspect, the tail portion 3008 may be connectable to a crane (not shown) to lift the perforating gun assembly 3000 from a ground surface and into the wellbore. Other uses of the tail portion 3008 may be suitable, though not expressly recited herein.

Figure 32:
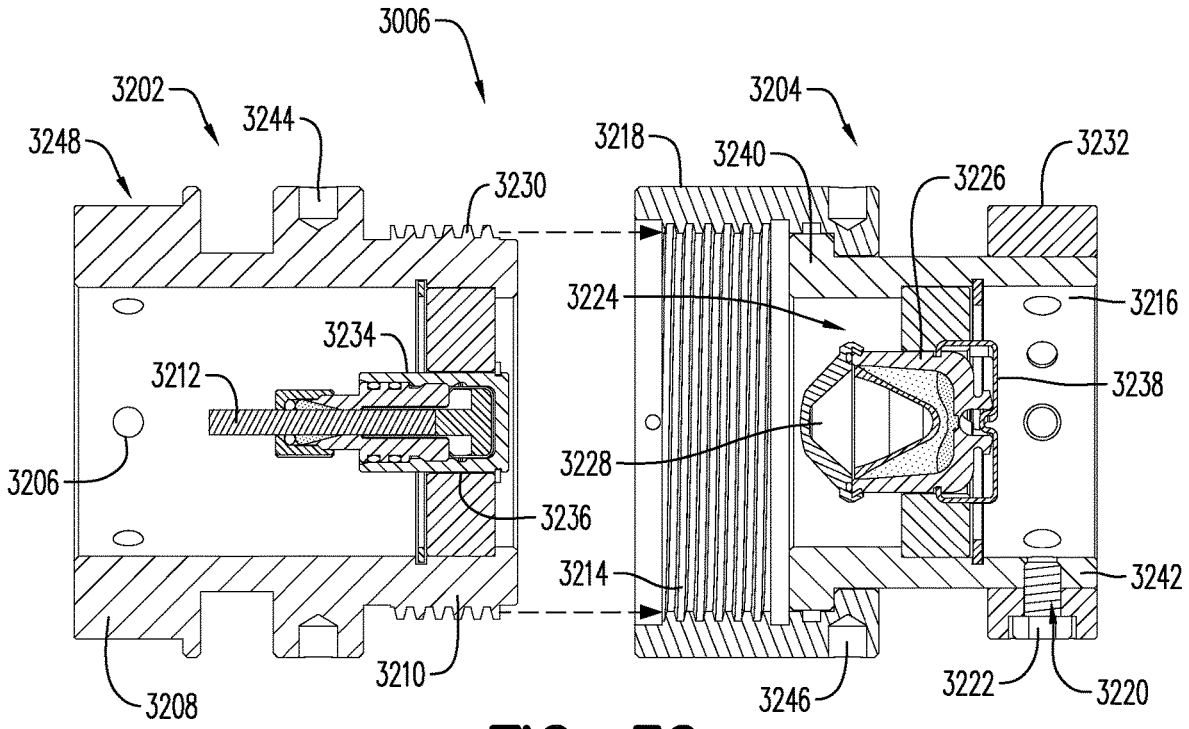
FIG. 32 illustrates a cross-sectional view of a connector including a first connector portion and a second connector portion, in accordance with an embodiment.

FIG. 32 is a cross-sectional view of the connector 3006. The connector 3006 can include a first connector portion 3202, a second connector portion 3204, and a shaped charge carrier collar 3232. Each of the first connector portion 3202 and the second connector portion 3204 can include a first end and a second end. According to an aspect, and as illustrated in FIG. 32, the second end 3230 of the first connector portion 3202 is receivable within the first end 3218 of the second connector portion 3204. According to an aspect, the second end 3230 of the first connector portion 3202 and the first end 3218 of the second connector portion 3204 can be connected to each other using a threaded connection. Threads used to form the threaded connection may be a continuous thread or a plurality of non-continuous threads. In some embodiments, external threads 3210 are provided on the second end 3230, while internal threads 3214 are provided on the first end 3218.

The first end 3208 of the first connector portion 3202 is illustrated having a plurality of screw holes 3206. While six holes are illustrated (three on each half portion of the first connector portion 3202), other embodiments of the first end 3218 may include three screw holes 3206 spaced apart from each other. In some embodiments, the quantity of screw holes 3206 provided may be modified depending on the configuration of the second connector portion 3204. According to an aspect, the screw holes 3206 are threaded. The outer diameter of the first end 3208 of the first connector portion 3202 may be dimensioned so that it will be receivable in the inner diameter of the shaped charge carrier 500, the shaped charge carrier 1700 or the shaped charge carrier 2900. An uphole end of the shaped charge carrier 500, the shaped charge carrier 1700 or the shaped charge carrier 2900 may be pushed over the first end 3208 of the first connector portion 3202 until the shaped charge carrier collar 3232 is within the shaped charge carrier 500, the shaped charge carrier 1700 or the shaped charge carrier 2900. Fasteners or screws can then inserted into the holes to secure the first connector portion 3202 to the shaped charge carrier 500, the shaped charge carrier 1700 or the shaped charge carrier 2900.

Figure 33:
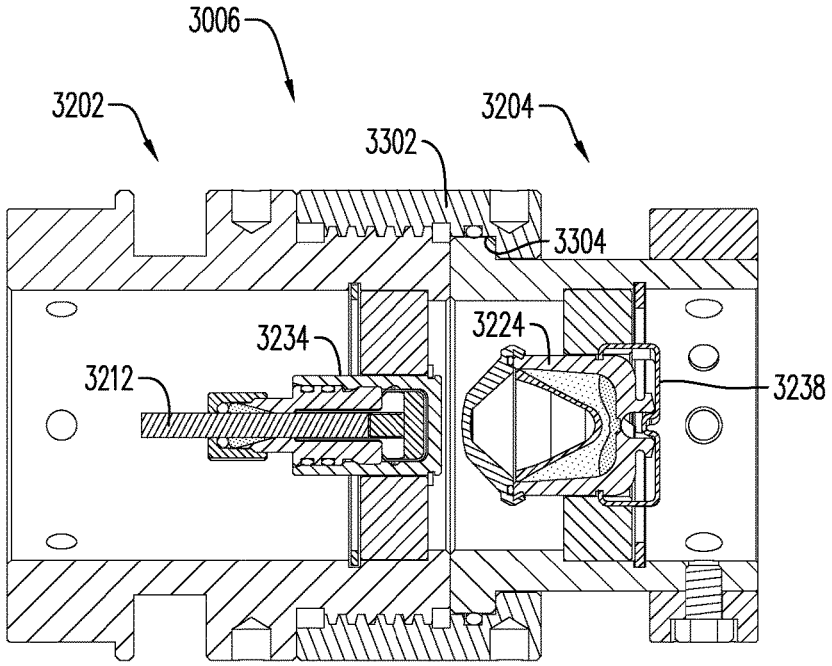
FIG. 33 illustrates a first connector portion and a second connector portion of a connector in a spaced apart configuration, in accordance with an embodiment.

The second connector portion 3204 may have an outer diameter that is less that the inner diameter of the shaped charge carrier 2900. In order to help facilitate a secure fit between the second connector portion 3204 and the shaped charge carrier 2900, a shaped charge carrier collar 3232/adapter ring may be provided. The shaped charge carrier collar 3232 increases the outer diameter of the second connector portion 3204 so that it is of a similar size as the inner diameter of the shaped charge carrier 2900 within which it will be positioned. The shaped charge carrier collar 3232 may also serve as a stop for the second connector portion 3204. A plurality of screw holes 3216 may be provided on the second connector portion 3204. The screw holes 3216 may be spaced apart from the first end 3218 of the second connector portion 3204. The screw holes 3206 may be configured to receive fasteners to connect the second connector portion 3204 to the shaped charge carrier collar 3232. According to an aspect, the screw holes 3216 are circumferentially disposed around the second connector portion 3204. The second connector portion 3204 may include nine screw holes 3216, three of which may be used to connect the second connector portion 3204 to the shaped charge carrier collar 3232 (FIG. 32 and FIG. 33). The remaining six holes may be used to secure or affix the shaped charge carrier 2900 to the second connector portion 3204, similar to the connection between the first connector portion 3202 and the shaped charge carrier 2900.

According to an aspect, the first connector portion 3202 can include a receiver booster/booster 3212. The booster 3212 may include explosives housed within a booster hull/booster shell. The booster hull may encapsulate the explosives.

According to an aspect, the second connector portion 3204 includes a donor shaped charge 3224. The donor shaped charge 3224 is configured to detonate the booster 3212, which detonates a detonative device (which may be, for example, a detonating cord, another booster, explosive pellets) positioned in the shaped charge carrier 2900 to which the first end 3208 of the first connector portion 3202 is connected. The booster 3212 and the donor shaped charge 3224 may be aligned along a central axis of the connector 3006, that is the connected first connector portion 3202 and second connector portion 3204 (FIG. 33).

The booster 3212 may be positioned in a holder 3234. According to an aspect, the holder 3234 may engage an inner surface 3236 of the first connector portion 3202 to secure the booster 3212 in the first connector portion 3202 and prevent axial or radial movement thereof. An engagement mechanism 3238 may retain the donor shaped charge 3224 in the second connector portion 3204. The engagement mechanism 3238 may engage an inner surface of the second connector portion 3204 to secure the donor charge in the second connector portion 3204 and prevent axial or radial movement thereof. The engagement mechanism 3238 may help to fix the detonating cord (not shown) at the end of the donor shaped charge 3224. According to an aspect, the engagement mechanism 3238 is configured as a circlip, snap ring or C-clip, which fixes the donor shaped charge 3224 in position within the second connector portion 3204. A collar of a closure member of the lid of the donor shaped charge 3224 may touch a surface of the booster 3212 or holder 3234, while engagement mechanism 3238 may touch a portion of the perforating gun assembly 3000 to which it is connected, in order to restrict movements in the axial direction.

The second connector portion 3204 may include a first end 3218 and a second end 3242 spaced apart from the first end 3218. The first end 3218 of the second connector portion 3204 may be defined by a lip 3240 extending radially outwardly from the first end 3218. The second connector portion 3204 is coupled with an outer connector ring 3302 such that the lip 3240 abuts an inwardly projecting shoulder 3304 of the outer connector ring 3302. According to an aspect, an o-ring is positioned adjacent a portion of the inwardly projecting shoulder 3304 of the outer connector ring 3302. The o-ring may provide additional friction to prevent any unintended release of the threaded connection by vibrations during the deployment of the perforating guns.

According to an aspect, the connector 3006 is configured to selectively orient the attached first and second shaped charge carriers so that the shaped charges 902 are oriented in a desired orientation in the wellbore. Each of the second end 3230 of the first connector portion 3202 and the first end 3218 of the second connector portion 3204 may be configured with one or more openings for receiving a male connector/connector pin. The openings may be formed on abutting axial surfaces of each of the second end of the first connector portion and the first end of the second connector portion in an asymmetric pattern, for example at 140, 110, and −110 degrees around the central axis of the connector. This helps to ensure that the first connector portion 3202 and second connector portion 3204 engage with each other in only one orientation. Once the male connectors/pins are positioned in each of the respective openings of the second end 3230 of the first connector portion 3202 and the first end 3218 of the second connector portion 3204, the outer connector ring 3302 is fastened to the first connector portion 3202 via the threaded engagement. Tooling hole 3244, and tooling hole 3246 may be provided on an outer surface of each of the first connector portion 3202 and the outer ring outer connector ring 3302 to tighten the threaded engagement.

A shoulder portion 3248 of the first connector portion 3202 may be provided on the first end 3208 of the first connector portion 3202. According to an aspect, the screw hole 3206 formed through the shoulder is able to receive fasteners or screws that are also connected to a corresponding end of the first shaped charge carrier 3002. The first shaped charge carrier 3002 may be configured to be positioned over the shoulder of the first connector portion 3202, so that screws holes at its corresponding end aligns with the screw holes 3206 of the first connector portion 3202. A screw may be inserted through each of the screw holes 3206 and the screw holes of the first shaped charge carrier 3002 to couple the components and prevent rotation of the first shaped charge carrier 3002 relative to the first connector portion 3202.

A plurality of screw holes 3216 may be provided around the second end 3242 of the second connector portion 3204 for connection to the second shaped charge carrier 3004. A shaped charge carrier collar 3232 with corresponding screw holes may be connected via one or more screws or fasteners 3222 to the second end of the second connector portion 3204 to couple the components and prevent rotation of the shaped charge carrier collar 3232 relative to the second connector portion 3204. An end of the second shaped charge carrier 3004 may be positioned over shaped charge carrier collar 3232. A screw hole in the end of the second shaped charge carrier 3004 can be aligned with a screw hole in the shaped charge carrier collar 3232 and a fastener 3222 may be passed through each of the screw holes to couple the components and prevent rotation of the second shaped charge carrier 3004 relative to the shaped charge carrier collar 3232.

FIG. 33 is a cross-sectional view of the connector 3006 in its assembled configuration.

Figure 34:
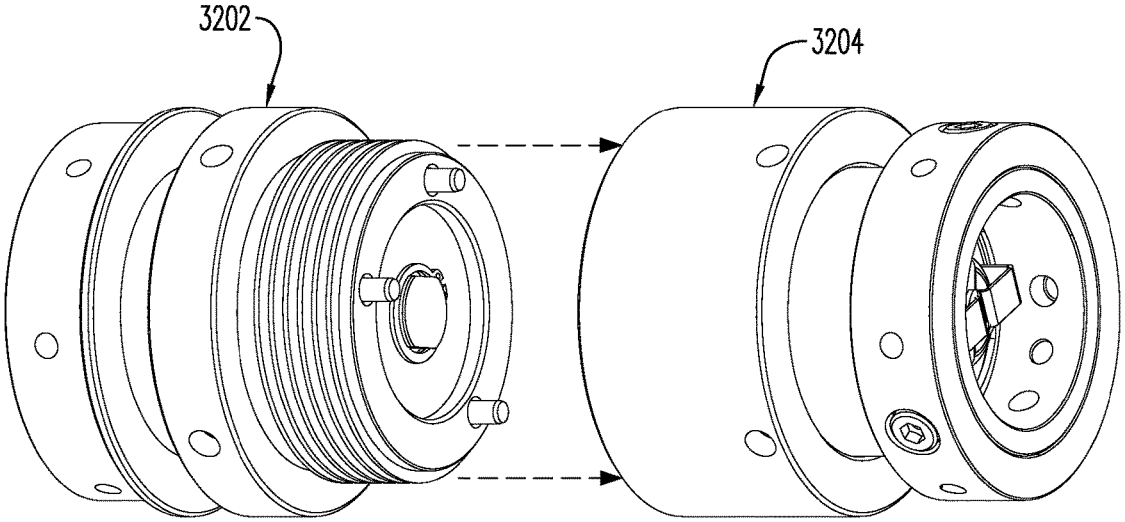
FIG. 34 illustrates a first connector portion and a second connector portion of a connector in a spaced apart configuration, in accordance with an embodiment.

FIG. 34 illustrates first connector portion 3202 being disconnected from the second connector portion 3204, such that fasteners 3222 (FIG. 36) that help to secure the first connector portion 3202 to the second connector portion 3204 are exposed. While the fasteners 3222 appear to be configured as generally cylindrical structures in this embodiment, other configurations are contemplated.

Figure 35:
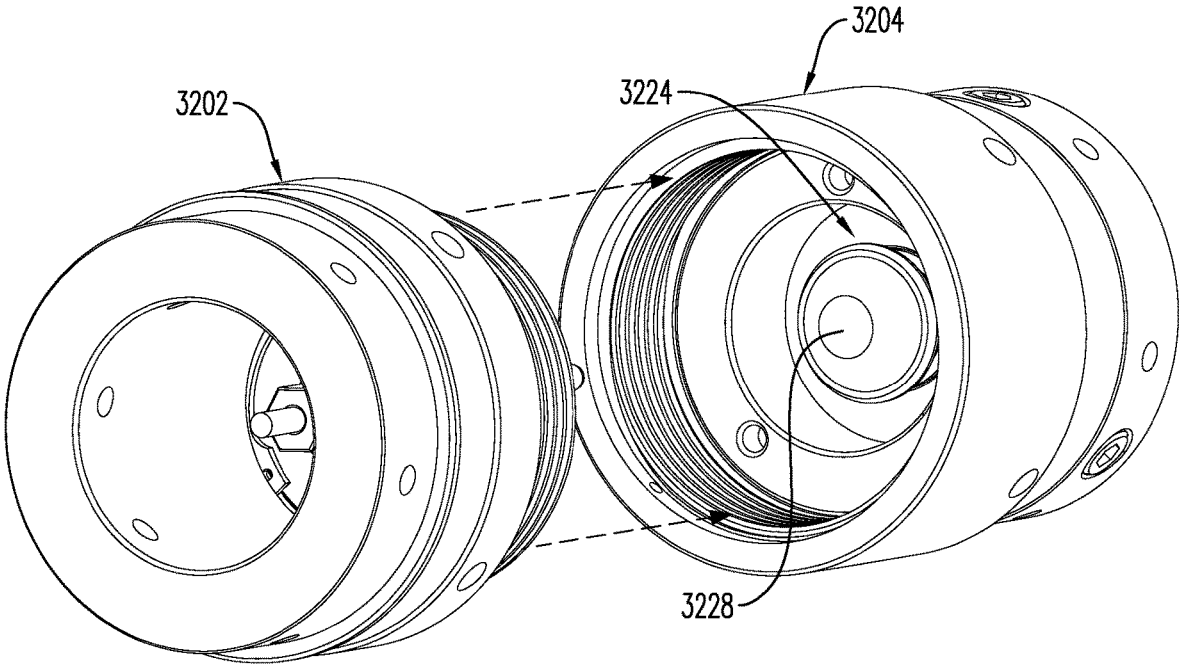
FIG. 35 illustrates a first connector portion and a second connector portion of a connector in a spaced apart configuration, in accordance with an embodiment.

FIG. 35 illustrates first connector portion 3202 being disconnected from the second connector portion 3204, such that the lid 3228 of the donor shaped charge 3224 can be seen.

Figure 36:
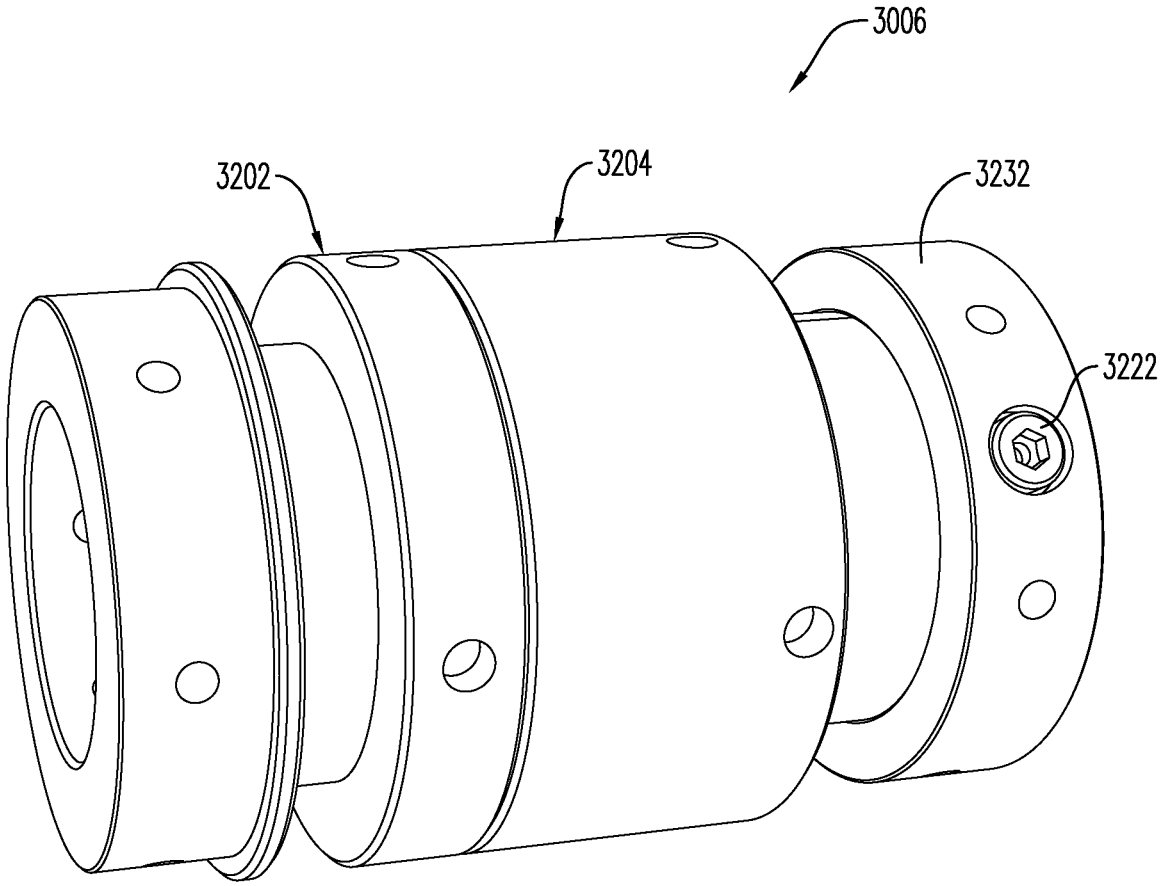
FIG. 36 illustrates a first connector portion and a second connector portion of a connector in an assembled configuration, in accordance with an embodiment.

FIG. 36 illustrates the connector 3006 in an assembled configuration. As described hereinabove the first connector portion 3202 is illustrated as being connected to the second connector portion 3204.

Figure 37:
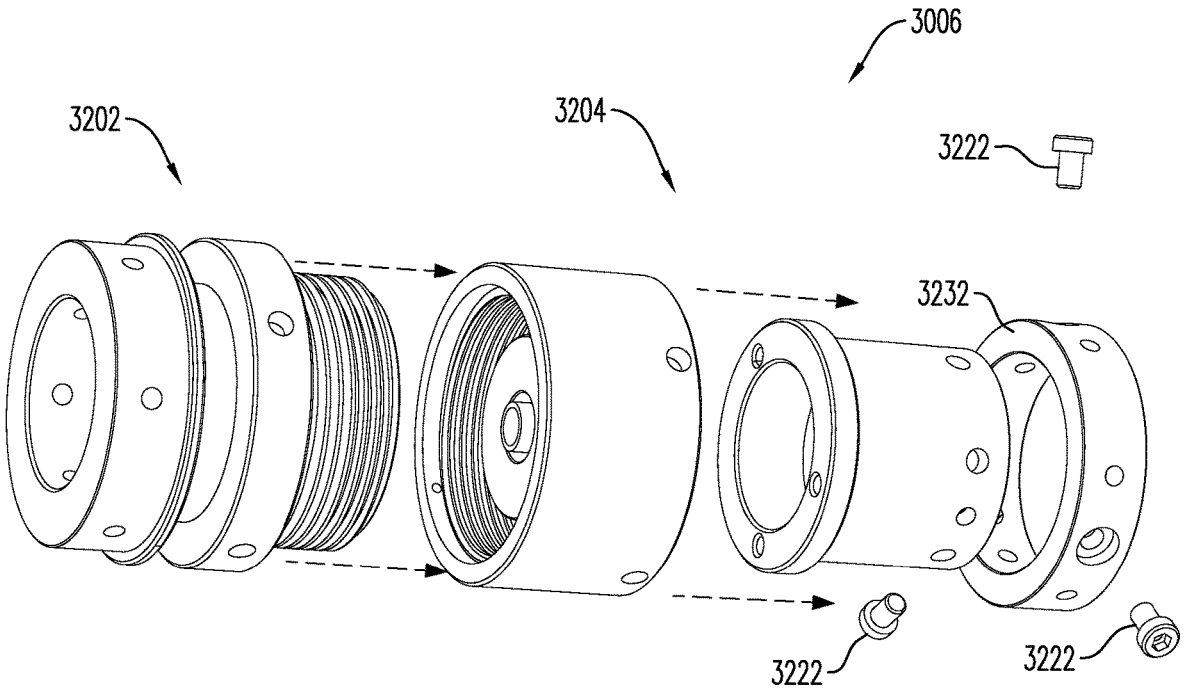
FIG. 37 illustrates the first connector portion and the second connector portion of FIG. 36 in a disassembled configuration, in accordance with an embodiment.

FIG. 37 is an exploded view of the connector 3006. The first connector portion 3202 is illustrated as being disconnected from the second connector portion 3204.

Figure 38:
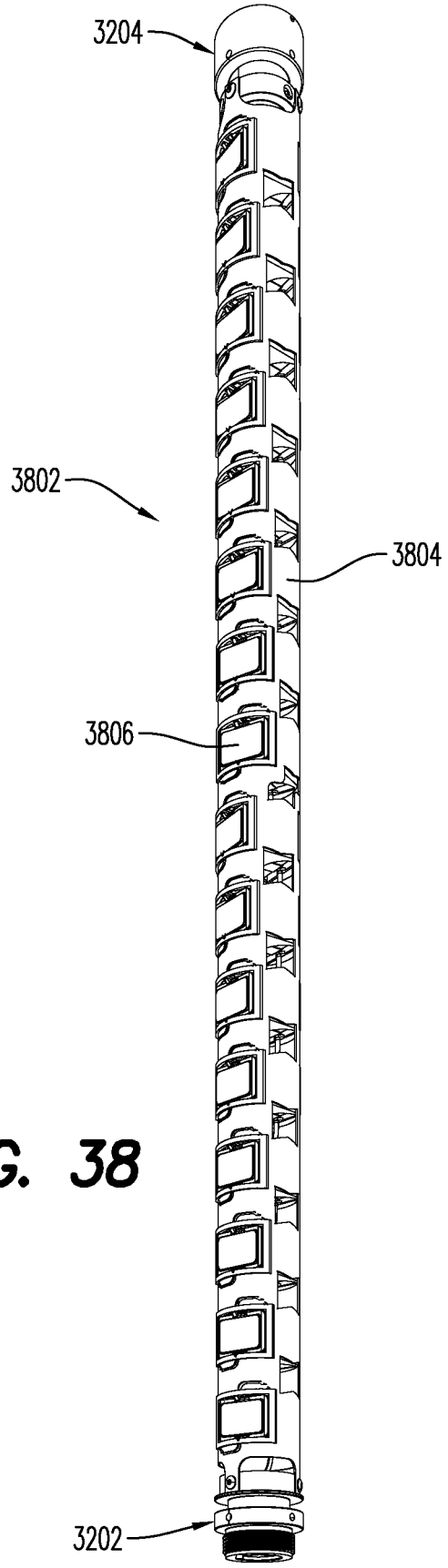
FIG. 38 illustrates a shaped charge carrier, and a first connector portion and a second connector portion secured to the shaped charge carrier, in accordance with an embodiment.

FIG. 38 is a perspective view of a perforation perforating gun assembly 3802 including a shaped charge carrier 3804 and a plurality of shaped charges 3806 positioned in the shaped charge carrier. It is contemplated that the shaped charge carrier 3804 may be configured as shaped charge carrier 500, shaped charge carrier 1700, or shaped charge carrier 2900. Alternatively, shaped charge carrier 3804 may include one or more features of shaped charge carrier 500, shaped charge carrier 1700, and shaped charge carrier 2900. For example, the shaped charge carrier 3804 may include orientation slots 1704 as well as tabs (for example, tab 502, tab 504, and/or tab 512) to help secure the shaped charges 3806 in the shaped charge carrier 3804. Similarly, the shaped charges 3806 positioned in shaped charge carrier 3804 may be configured substantially as the shaped charge 902 described hereinabove.

As illustrated in FIG. 38, a first end of the shaped charge carrier 3804 is connected to a first connector portion 3202 and a second end of the shaped charge carrier 3804 is connected to a second connector portion 3204.

Figure 39:
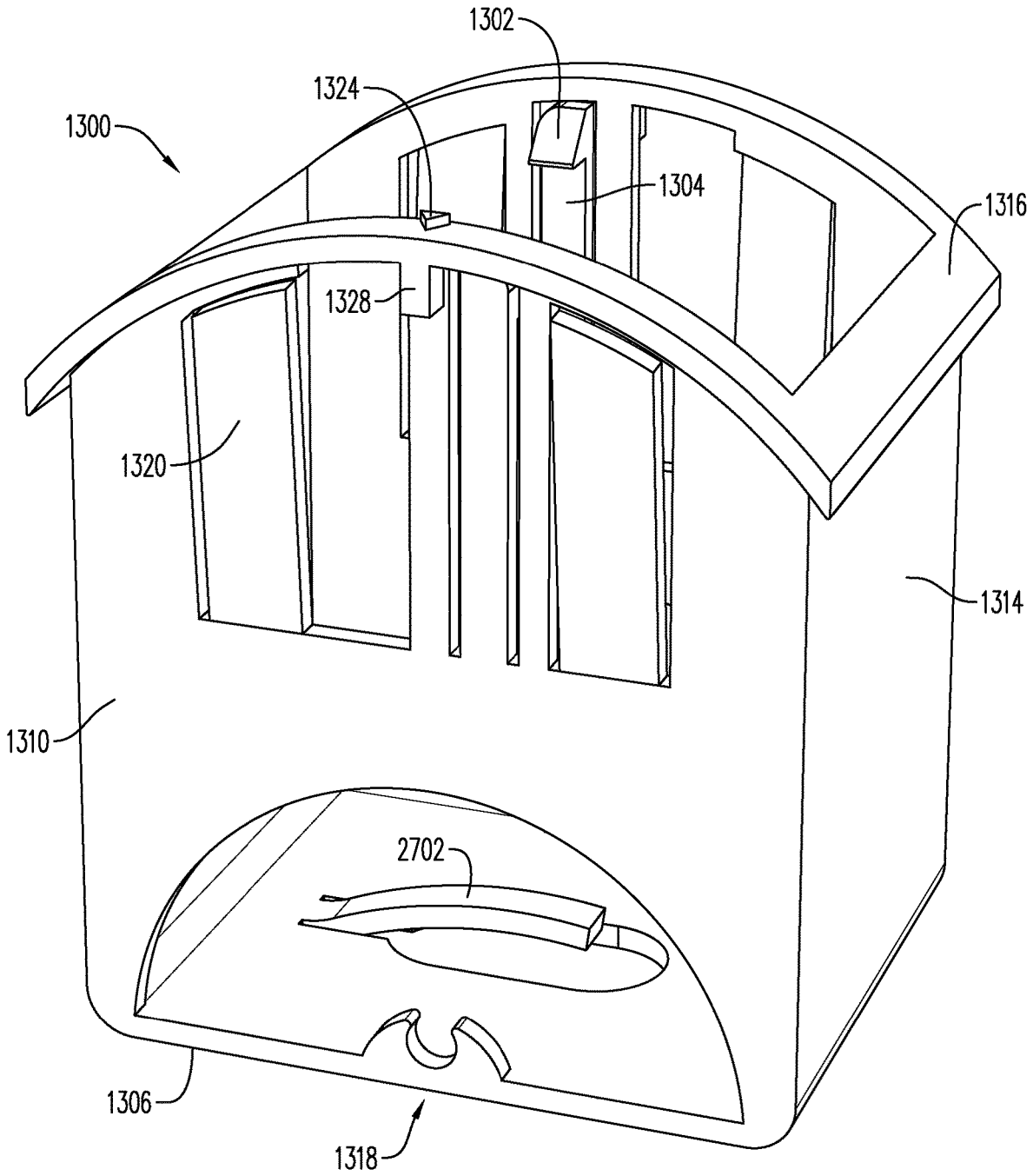
FIG. 39 illustrates a jacket configured for being received in the shaped charge carrier of FIG. 38.
Figure 40A:
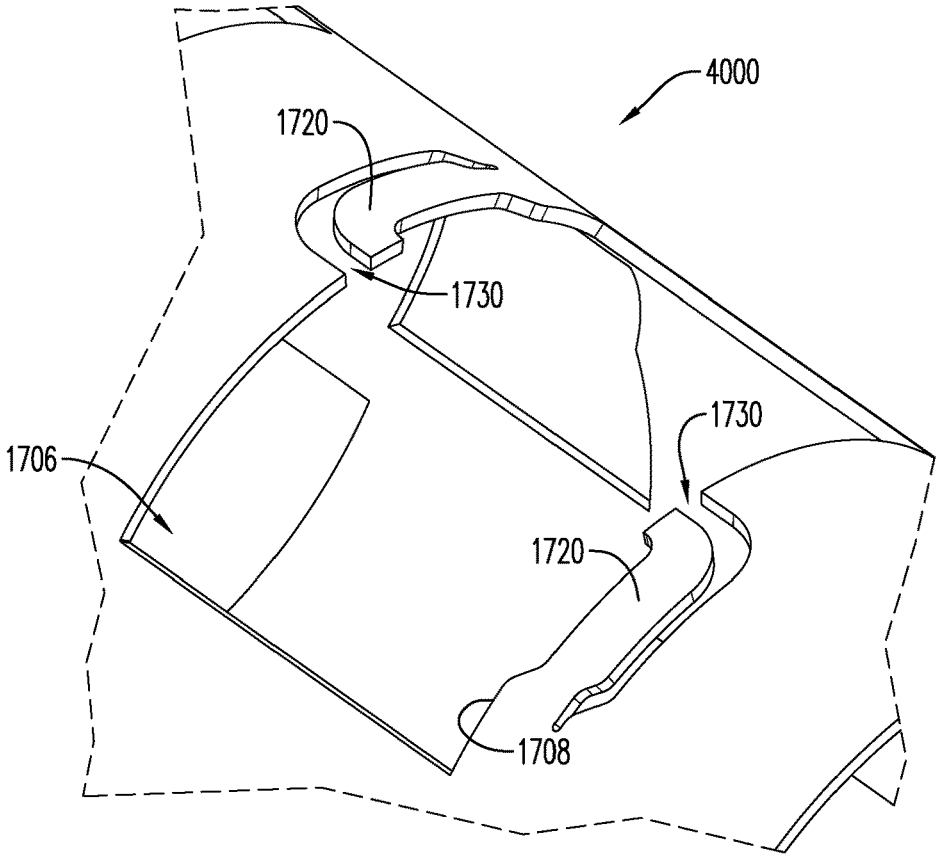
FIG. 40A illustrates a portion of the shaped charge carrier of FIG. 38.
Figure 40B:
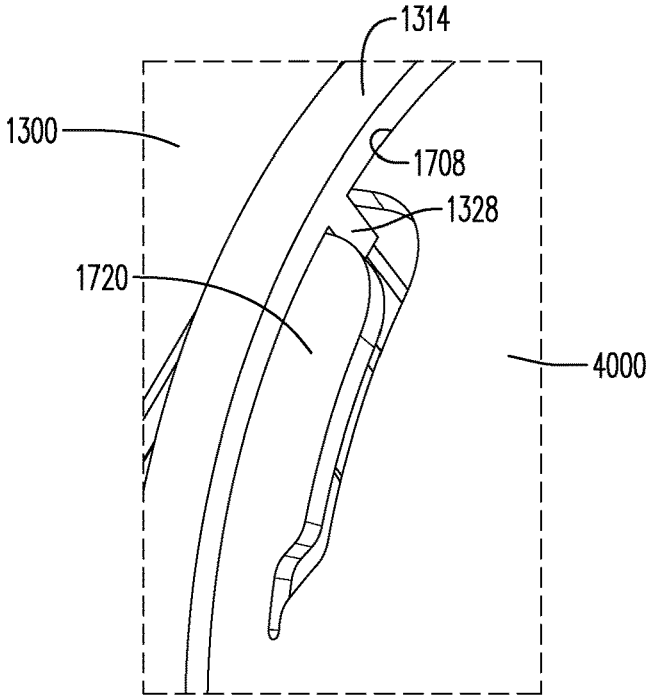
FIG. 40B illustrates the jacket of FIG. 39 secured in the shaped charge carrier of FIG. 38.

FIG. 39 illustrates a jacket 1300 configured for being received in the shaped charge carrier of FIG. 38. While the jacket 1300 may be configured substantially as illustrated in FIGS. 13-16 and described hereinabove, the jacket may include a protrusive element 1328 extending away from external surface of at least one of the top wall, the bottom wall, the first sidewall and the second sidewall. According to an aspect, the protrusive element 1328 may be configured to be received within an orientation tab 1720 (FIG. 40A and FIG. 40B) formed on a peripheral edge portion 1708 of a shaped charge receptacle 1706 formed in a shaped charge carrier 4000. The shaped charge carrier 4000 may be configured substantially the same as the shaped charge carrier 1700 described hereinabove and illustrated in at least FIGS. 17-18. It is contemplated that rather than orientation slots, the shaped charge carrier 400 may include the orientation tab 1720. A channel 1730, extending from the shaped charge receptacle 1706, may be laser cut into the shaped charge carrier tube to form the orientation tab 1720. FIG. 40B illustrates the jacket 1300 of FIG. 39 secured in the shaped charge carrier 4000.

Embodiments described herein relate generally to devices, systems, and methods for an encapsulated shaped charge for an exposed perforating gun, and associated methods. For purposes of this disclosure, the phrases "devices," "systems," and "methods" may be used either individually or in any combination referring without limitation to disclosed components, grouping, arrangements, steps, functions, or processes.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A jacket for housing a shaped charge in a shaped charge carrier, comprising:

a back wall;

a top wall, and a bottom wall spaced apart from the top wall;

a first sidewall extending from the back wall and between the top wall and bottom wall;

a second sidewall spaced apart from the first sidewall, and extending from the back wall and between the top wall and bottom wall;

an open front portion opposite the back wall portion;

an internal cavity defined by the back wall, the top wall, the bottom wall, the first sidewall and the second sidewall, wherein the internal cavity is configured to receive the shaped charge via the open front portion;

a key extending from one of the top wall, the bottom wall, the first sidewall or the second sidewall, wherein the key is configured to be received within one of a plurality of orientation slots formed in the shaped charge carrier;

a retention latch extending from an internal surface of at least one of the top wall, the bottom wall, the first sidewall or the second sidewall, wherein the retention latch extends toward the internal cavity and is configured to secure the shaped charge within the internal cavity; and a detonating cord receptacle extending from the back wall and extending within the internal cavity.

2. The jacket of claim 1, wherein the retention latch comprises:

an arm; and a protrusion extending in a radial direction away from the arm towards the internal cavity.

3. The jacket of claim 1, further comprising:

a housing retention mechanism configured to secure the jacket within an opening formed in the shaped charge carrier.

4. The jacket of claim 3, wherein at least a portion of the housing retention mechanism extends outwardly from at least one of the top wall, the bottom wall, the first sidewall or the second sidewall in a direction away from the internal cavity.

5. The jacket of claim 1, further comprising:

a collar extending around the open front portion, wherein the collar extends from each of the top wall, the bottom wall, the first sidewall and the second sidewall.

6. The jacket of claim 5, wherein the key extends upwardly from and in a direction perpendicular to the collar.

7. The jacket of claim 5, further comprising:

a protrusive element extending away from an external surface of at least one of the top wall, the bottom wall, the first sidewall or the second sidewall, wherein the protrusive element is configured to be received within an orientation tab formed on a peripheral edge portion of a shaped charge receptacle formed in the shaped charge carrier.

8. The jacket of claim 1, wherein the jacket is formed from a material that is at least one of an injection molded, a casted or a 3D printed plastic material, a 3-D milled plastic material, and a material cut from a solid plastic bar stock.

9. A perforating gun assembly comprising:

a shaped charge carrier comprising:

a wall, at least one shaped charge receptacle extending through the wall, and an orientation slot or an orientation tab formed into a peripheral edge portion of the at least one shaped charge receptacle; and a jacket positioned in the at least one shaped charge receptacle, wherein the jacket comprises:

a back wall;

a top wall and a bottom wall spaced apart from the top wall;

a first sidewall extending from the back wall and between the top wall and bottom wall;

a second sidewall spaced apart from the first sidewall, and extending from the back wall and between the top wall and bottom wall;

an internal cavity defined by the back wall, the top wall, the bottom wall, the first sidewall and the second sidewall;

a retention latch extending from an internal surface of the top wall, the bottom wall, the first sidewall or the second sidewall, wherein the retention latch extends toward the internal cavity and is configured to secure a shaped charge within the internal cavity;

a key configured for being received within the orientation slot; or a protrusive element configured to be received within the orientation tab; and a detonating cord receptacle extending from the back wall and extending within the internal cavity.

10. The perforating gun assembly of claim 9, wherein the orientation slot is one of a plurality of orientation slots, wherein each orientation slot is circumferentially spaced apart from other orientation slots.

11. The perforating gun assembly of claim 10, wherein a first orientation slot of the plurality of orientation slots defines a phasing of 0 degrees, and a second orientation slot of the plurality of orientation slots defines a phasing greater than or less than 0 degrees.

12. The perforating gun assembly of claim 9, wherein: the protrusive element extends away from an external surface of at least one of the top wall, the bottom wall, the first sidewall and the second sidewall.

13. A tool string for deployment into a wellbore, comprising:

a first shaped charge carrier and a second shaped charge carrier, wherein each of the first shaped charge carrier and the second shaped charge carrier comprises:

a wall, at least one shaped charge receptacle extending through the wall, and an orientation slot or an orientation tab formed into a peripheral edge portion of the at least one shaped charge receptacle;

a jacket positioned in the at least one shaped charge receptacle, the jacket comprising:

a back wall;

a top wall and a bottom wall spaced apart from the top wall;

a first sidewall extending from the back wall and between the top wall and bottom wall;

a second sidewall spaced apart from the first sidewall, and extending from the back wall and between the top wall and bottom wall;

an internal cavity defined by the back wall, the top wall, the bottom wall, the first sidewall and the second sidewall, wherein the internal cavity is configured to receive the shaped charge;

a retention latch extending from an internal surface of at least one of the top wall, the bottom wall, the first sidewall and the second sidewall, wherein the retention latch extends toward the internal cavity and is configured to secure the shaped charge within the internal cavity;

a key configured for being received within the orientation slot or a protrusive element configured to be received within the orientation tab; and a detonating cord receptacle extending from the back wall and extending within the internal cavity;

a shaped charge positioned in the jacket; and a connector extending between the first shaped charge carrier and the second shaped charge carrier, wherein the connector is configured for orienting the first shaped charge carrier relative to the second shaped charge carrier.

14. The tool string of claim 13, wherein the connector comprises:

a first connector portion secured to the first shaped charge carrier; and a second connector portion secured to the second shaped charge carrier.

15. The tool string of claim 14, wherein the connector further comprises:

a booster positioned in the first connector portion; and a donor shaped charge positioned in the second connector portion.

16. The tool string of claim 13, wherein the jacket further comprises: a housing retention mechanism extending outwardly from an external surface of at least one of the top wall, the bottom wall, the first sidewall or the second sidewall towards the open front portion, wherein the housing retention mechanism is configured to secure the jacket within the at least one shaped charge receptacle.

* * * * *